US012768157B2

(12) United States Patent
Nakamura et al.

(10) Patent No.: US 12,768,157 B2
(45) Date of Patent: Oct. 20, 2026

(54) FLUSH TOILET

(71) Applicant: TOTO LTD., Fukuoka (JP)

(72) Inventors: Kenichi Nakamura, Fukuoka (JP); Hiroshi Hashimoto, Fukuoka (JP); Shinichi Urata, Fukuoka (JP); Takumi Tsuchitani, Fukuoka (JP); Chisato Sone, Fukuoka (JP); Jing Chen, Fukuoka (JP); Wataru Ishimi, Fukuoka (JP); Naoki Abe, Fukuoka (JP); Daisuke Yamamoto, Fukuoka (JP)

(73) Assignee: Toto Ltd., Fukuoka (JP)

( * ) Notice: Subject to any disclaimer, the term of this patent is extended or adjusted under 35 U.S.C. 154(b) by 189 days.

(21) Appl. No.: 18/783,541

(22) Filed: Jul. 25, 2024

(65) Prior Publication Data

US 2025/0043559 A1 Feb. 6, 2025

(30) Foreign Application Priority Data

Jul. 31, 2023 (JP) ..... 2023-124611
Jul. 31, 2023 (JP) ..... 2023-124614
(Continued)

(51) Int. Cl.
*E03D 11/08* (2006.01)

(52) U.S. Cl.
CPC ..... *E03D 11/08* (2013.01); *E03D 2201/30* (2013.01); *E03D 2201/40* (2013.01)

(58) Field of Classification Search
CPC . E03D 11/08; E03D 2201/30; E03D 2201/40; E03D 11/02; E03D 5/00; E03D 11/18
See application file for complete search history.

(56) References Cited

U.S. PATENT DOCUMENTS 6,115,853 A 9/2000 Shibata et al.
9,303,395 B2 * 4/2016 Shirakawa ..... E03D 11/08
(Continued)

FOREIGN PATENT DOCUMENTS

CN 213204360 U 5/2021
JP H07-180202 A 7/1995
(Continued)

OTHER PUBLICATIONS

Translation of JP-2008248637-A (Year: 2026).*
(Continued)

*Primary Examiner* — Janie M Loeppke
(74) *Attorney, Agent, or Firm* — BakerHostetler

(57) ABSTRACT

A flush toilet includes a reservoir tank, a bowl, a rim spout port, a discharge trap conduit, a jet spout port configured to spout flush water toward an inlet of the discharge trap conduit, a jet water conduit configured to supply the flush water from the reservoir tank to the jet spout port, and a discharge device configured to supply or stop supplying the flush water to the jet water conduit, wherein the flush water is spouted at a first flow rate from the jet spout port when the discharge device is driven and the flush water in the reservoir tank flows into the jet water conduit and, after spouting of the first flow rate ends, the flush water is spouted at a second flow rate from the jet spout port due to the flush water retained in the jet water conduit flowing toward the jet spout port.

19 Claims, 22 Drawing Sheets

(30) Foreign Application Priority Data

| | | |
|---|---|---|
| Jul. 31, 2023 | (JP) | 2023-124615 |
| Jul. 31, 2023 | (JP) | 2023-124616 |
| Jan. 26, 2024 | (JP) | 2024-010048 |

(56) References Cited

U.S. PATENT DOCUMENTS

| | | | | |
|---|---|---|---|---|
| 2012/0284910 | A1* | 11/2012 | Shirakawa | E03D 11/08 4/420 |
| 2015/0026876 | A1 | 1/2015 | Shirakawa et al. | |
| 2020/0284016 | A1 | 9/2020 | Stammel | |

FOREIGN PATENT DOCUMENTS

| | | | | |
|---|---|---|---|---|
| JP | H10-103538 | A | | 4/1998 |
| JP | 2021-134602 | A | | 10/2001 |
| JP | 2002-294837 | A | | 10/2002 |
| JP | 2002-332674 | A | | 11/2002 |
| JP | 2002-364056 | A | | 12/2002 |
| JP | 2003-278251 | A | | 10/2003 |
| JP | 2006291451 | A | | 10/2006 |
| JP | 2008248637 | A | * | 10/2008 |
| JP | 2010531399 | A | | 9/2010 |
| JP | 2011-058208 | A | | 3/2011 |
| JP | 2012-207503 | A | | 10/2012 |
| JP | 2012-237125 | A | | 12/2012 |
| JP | 2013-050027 | A | | 3/2013 |
| JP | 2013-072238 | A | | 4/2013 |
| JP | 2014-034868 | A | | 2/2014 |
| JP | 2015025258 | A | | 2/2015 |
| JP | 2018-003250 | A | | 1/2018 |
| JP | 2018-012995 | A | | 1/2018 |
| JP | 2018168671 | A | | 11/2018 |
| JP | 2001-279789 | A | | 9/2021 |
| JP | 2021-156106 | A | | 10/2021 |
| JP | 2023-095364 | A | | 7/2023 |
| WO | 2009002062 | A2 | | 12/2008 |

OTHER PUBLICATIONS

Japanese Official Action issued on Jun. 27, 2025 (with an English translation).
The Official Action of JP Pat. Appln. No. 2023-124616 dated Aug. 27, 2025 (English Translation).
The Official Action of JP Pat. Appln. No. 2024-010048 dated Oct. 27, 2025 (English Translation).
Japanese Official Action issued on Jun. 26, 2025 (with an English translation).

* cited by examiner

FLUSH TOILET

This application claims benefit of priority to Japanese Patent Applications No. 2023-124611, filed on Jul. 31, 2023, No. 2023-124614, filed on Jul. 31, 2023, No. 2023-124615, filed on Jul. 31, 2023, No. 2023-124616, filed on Jul. 31, 2023, No. 2024-010048, filed on Jan. 26, 2024, the entire contents of which are incorporated herein by reference.

BACKGROUND OF THE INVENTION

Field of the Invention

The present invention relates to a flush toilet and, in particular, to a siphon jet flush toilet.

Description of the Related Art

Conventionally, siphon jet flush toilets are known in which waste is discharged by spouting flush water from a jet spout port and generating a siphon action inside a discharge trap conduit. Siphon jet flush toilets include a low silhouette type toilet which is equipped with a reservoir tank that stores flush water and in which a lower part of the reservoir tank is arranged at a lower position than an upper surface of a rim (for example, Japanese Translation of PCT International Application Publication No. 2010-531399 and Japanese Patent Laid-Open No. 2006-291451). A low silhouette type toilet advantageously features a low reservoir tank and superior appearance design property of the toilet as a whole.

However, in a low silhouette type siphon jet flush toilet, a part of the reservoir tank is arranged at a lower position than the upper surface of the rim and a jet water conduit is arranged at a lower position than a top portion of a discharge trap. Therefore, since sufficient head pressure cannot be exerted on the flush water flowing through the jet water conduit, sufficient jet spouting for discharging waste cannot be performed and, consequently, a problem arises in that waste discharge performance declines.

In consideration thereof, the present invention has been made in order to solve the problem described above and an object thereof is to provide a siphon jet flush toilet which is capable of performing sufficient jet spouting for discharging waste and which enables waste discharge performance to be improved.

SUMMARY OF THE INVENTION

In order to achieve the object described above, the present invention provides a siphon jet flush toilet, including: a reservoir tank configured to store flush water; a bowl including a bowl-shaped waste receiving surface and a rim formed along a top edge portion of the bowl; a rim spout port provided on the rim and configured to spout the flush water toward the bowl; a discharge trap conduit provided in a bottom portion of the bowl and including an ascending conduit that extends upward, a descending conduit that extends downward from the ascending conduit, and a top portion that is positioned between the descending conduit and the ascending conduit and that regulates a seal water level; a jet spout port provided in the bottom portion of the bowl and configured to spout the flush water toward an inlet of the discharge trap conduit; a jet water conduit connecting the jet spout port and the reservoir tank to each other and configured to supply the flush water from the reservoir tank to the jet spout port; and a discharge device configured to supply or stop supplying the flush water stored in the reservoir tank to the jet water conduit, wherein the flush water is spouted at a first flow rate from the jet spout port when the discharge device is driven and the flush water in the reservoir tank flows into the jet water conduit and, after spouting of the first flow rate ends, the flush water is spouted at a second flow rate from the jet spout port due to the flush water retained in the jet water conduit flowing toward the jet spout port.

In the present invention configured in this manner, since the flush water is spouted at the first flow rate from the jet spout port when the discharge device is driven and the flush water in the reservoir tank flows into the jet water conduit and, after spouting of the first flow rate ends, the flush water is spouted at the second flow rate from the jet spout port due to the flush water retained in the jet water conduit flowing toward the jet spout port, a siphon action can be generated by the first flow rate and the siphon action can be continued by the second flow rate. Accordingly, a sufficient siphon action for discharging waste can be generated and continued and, accordingly, waste discharge performance can be improved.

In addition, in the present invention, preferably, a maximum instantaneous flow rate of the second flow rate is set smaller than a maximum instantaneous flow rate of the first flow rate.

In the present invention configured in this manner, since the maximum instantaneous flow rate of the second flow rate is set smaller than the maximum instantaneous flow rate of the first flow rate, the siphon action can be continued by the second flow rate of which the maximum instantaneous flow rate is small. Accordingly, both an improvement in waste discharge performance and water conservation can be achieved.

In the present invention, preferably, an instantaneous flow rate of the second flow rate is set so as to reach the maximum instantaneous flow rate by increasing more gradually than an instantaneous flow rate of the first flow rate.

In the present invention configured in this manner, since the instantaneous flow rate of the second flow rate is set so as to reach the maximum instantaneous flow rate by increasing more gradually than the instantaneous flow rate of the first flow rate, the flush water spouted from the jet spout port can be prevented from being disturbed as compared to rapidly increasing the instantaneous flow rate. Accordingly, the flush water can cause the siphon action to continue by smoothly flowing into the discharge trap conduit.

In addition, in the present invention, preferably, a flush water amount is set to be switched between a large flush and a small flush by adjusting a jet spouting time by the first flow rate.

In the present invention configured in this manner, since the flush water amount is set to be switched between a large flush and a small flush by adjusting the jet spouting time by the first flow rate, the flush water amount can be reliably switched.

In the present invention, preferably, the flush water is spouted at the second flow rate from the jet spout port after the discharge device stops.

In the present invention configured in this manner, since the flush water is spouted at the second flow rate from the jet spout port after the discharge device stops, the flush water can be spouted at the second flow rate from the jet spout port by the flush water retained in the jet water conduit.

In addition, in the present invention, preferably, the jet water conduit includes an upstream flow channel extending forward from the reservoir tank, a bending flow channel bending from the upstream flow channel, and a downstream flow channel extending rearward from the bending flow channel and connecting to the jet spout port, and the upstream flow channel is arranged approximately parallel to the discharge trap conduit and a bottom surface on a downstream side of the upstream flow channel is positioned lower than an upper end of the inlet of the discharge trap conduit.

In the present invention configured in this manner, since the upstream flow channel is arranged approximately parallel to the discharge trap conduit and the bottom surface on the downstream side of the upstream flow channel is positioned lower than the upper end of the inlet of the discharge trap conduit, even when the seal water level drops and the siphon action almost ends, the flush water is continuously retained on the downstream side of the upstream flow channel and, therefore, the siphon action can be continued.

In the present invention, preferably, in a region more toward the front than the top portion of the discharge trap conduit, the bottom surface of the upstream flow channel is positioned lower than the upper end of the inlet of the discharge trap conduit.

In the present invention configured in this manner, since the bottom surface of the upstream flow channel is positioned lower than the upper end of the inlet of the discharge trap conduit in a region more toward the front than the top portion of the discharge trap conduit, even when the seal water level drops and the siphon action almost ends, the flush water is continuously retained in the upstream flow channel and, therefore, the siphon action can be continued.

In addition, in the present invention, preferably, a center of the jet spout port is arranged at a lowermost position of a center axis of the jet water conduit.

In the present invention configured in this manner, since the center of the jet spout port is arranged at the lowermost position of the center axis of the jet water conduit, the flush water can be spouted over a long period of time from the jet spout port.

In the present invention, preferably, the reservoir tank is provided with an overflow pipe configured to discharge overflowing water in the reservoir tank, and the overflow pipe is provided at a same position as the discharge device or more toward the rear than the discharge device.

In the present invention configured in this manner, since the reservoir tank is provided with the overflow pipe configured to discharge overflowing water in the reservoir tank and the overflow pipe is provided at a same position as the discharge device or more toward the rear than the discharge device, air displacement can be performed via the overflow pipe on a rearward side of the jet water conduit and a flow toward the jet spout port can be prevented from being blocked by the air displacement.

In addition, in the present invention, preferably, the jet water conduit has a capacity of ⅓ or more of the reservoir tank.

In the present invention configured in this manner, since the jet water conduit has a capacity of ⅓ or more of the reservoir tank, a large amount of flush water can be retained in the jet water conduit. Accordingly, sufficient jet spouting for discharging waste can be performed even when the reservoir tank is downsized.

In the present invention, preferably, the jet water conduit includes an upstream flow channel extending forward from the reservoir tank, a bending flow channel bending from the upstream flow channel, and a downstream flow channel extending rearward from the bending flow channel and connecting to the jet spout port, and a curved portion eccentrically positioned on an opposite side to the upstream flow channel with respect to the center axis of the jet spout port in a top view is formed in the downstream flow channel of the jet water conduit and the curved portion is arranged inside a seal water region in a top view.

In the present invention configured in this manner, since the curved portion eccentrically positioned on an opposite side to the upstream flow channel with respect to the center axis of the jet spout port is formed in the downstream flow channel of the jet water conduit, a flow velocity distribution of flush water spouted from the jet spout port can be made approximately uniform. Furthermore, since the curved portion is arranged inside the seal water region, the jet water conduit can be made compact. Accordingly, even when the jet water conduit is made compact, sufficient jet spouting for discharging waste can be performed and waste discharge performance can be improved.

In addition, in the present invention, preferably, the bending flow channel is arranged inside the seal water region in a top view.

In the present invention configured in this manner, since the bending flow channel is arranged inside the seal water region, the jet water conduit can be made compact. Furthermore, since the bending flow channel is arranged inside the seal water region, the bending flow channel can always be filled with water. Accordingly, retention of air inside the bending flow channel can be suppressed and the flow velocity distribution of flush water spouted from the jet spout port can be made approximately uniform.

In the present invention, preferably, a rectifying portion linearly extending toward the jet spout port is formed in the downstream flow channel on a downstream side of the curved portion.

In the present invention configured in this manner, since the rectifying portion linearly extending toward the jet spout port is formed in the downstream flow channel on a downstream side of the curved portion, the flush water after flowing through the curved portion can be rectified and the flow velocity distribution of flush water spouted from the jet spout port can be made approximately uniform.

In addition, in the present invention, preferably, the flush toilet further includes a buffer portion provided in the bottom portion of the bowl and communicating the jet spout port and the inlet of the discharge trap conduit to each other, wherein the jet water conduit includes an upstream flow channel extending forward from the reservoir tank, a bending flow channel bending from the upstream flow channel, and a downstream flow channel extending rearward from the bending flow channel and connecting to the jet spout port, and the jet water conduit and/or the buffer portion is configured such that the flush water spouted from the jet spout port flows toward a center of the inlet of the discharge trap conduit.

In the present invention configured in this manner, since the jet water conduit and/or the buffer portion is configured such that the flush water spouted from the jet spout port flows toward a center of the inlet of the discharge trap conduit, the flush water can be spouted from the jet spout port toward the center of the inlet of the discharge trap conduit even when the jet water conduit is made compact. Accordingly, the jet water conduit can be made compact, sufficient jet spouting for discharging waste can be performed, and waste discharge performance can be improved.

In the present invention, preferably, a curvature radius on a downstream side of an inner circumference surface of the bending flow channel of the jet water conduit is smaller than a curvature radius on an upstream side in a top view.

In the present invention configured in this manner, since the curvature radius on the downstream side of the inner circumference surface of the bending flow channel of the jet water conduit is smaller than the curvature radius on the upstream side in a top view and the inner circumference surface on the downstream side of the bending flow channel which is a portion where stagnation occurs is formed by a relatively small curvature radius, the bending flow channel can be made compact while suppressing an occurrence of energy loss.

In addition, in the present invention, preferably, a curvature radius on a downstream side of an outer circumference surface of the bending flow channel of the jet water conduit is larger than a curvature radius on an upstream side in a top view.

In the present invention configured in this manner, since the curvature radius on the downstream side of the outer circumference surface of the bending flow channel of the jet water conduit is larger than the curvature radius on the upstream side in a top view and the outer circumference surface on the downstream side of the bending flow channel where a relatively large amount of flush water flows is formed by a relatively large curvature radius, the flush water can be allowed to flow while maintaining its flow velocity, and an occurrence of flow separation on the outer circumference surface of the bending flow channel can be suppressed.

In the present invention, preferably, a bottom surface of the bending flow channel of the jet water conduit is formed approximately horizontally, an upper surface of the bending flow channel is inclined downward from an upstream side toward a downstream side, and a height position of the upper surface of the bending flow channel is higher on a side of the outer circumference surface than on a side of the inner circumference surface.

In the present invention configured in this manner, since the bottom surface of the bending flow channel of the jet water conduit is formed approximately horizontally, the upper surface of the bending flow channel is inclined downward from the upstream side toward the downstream side, and the height position of the upper surface of the bending flow channel is higher on a side of the outer circumference surface than on a side of the inner circumference surface, the side of the outer circumference surface can be made larger than the side of the inner circumference surface in a flow channel cross-sectional area of the bending flow channel and an occurrence of flow separation on the side of the outer circumference surface where a relatively large amount of flush water flows can be suppressed.

In addition, in the present invention, preferably, the jet water conduit includes an upstream flow channel extending forward from the reservoir tank, a bending flow channel bending from the upstream flow channel, and a downstream flow channel extending rearward from the bending flow channel and connecting to the jet spout port, a narrowed portion with a smallest flow channel cross-sectional area in the jet water conduit is formed in the downstream flow channel of the jet water conduit, and a constant cross-sectional area portion of which a flow channel cross-sectional area is constant is formed in the jet water conduit on an upstream side of the narrowed portion.

In the present invention configured in this manner, since the narrowed portion with a smallest flow channel cross-sectional area in the jet water conduit is formed in the downstream flow channel of the jet water conduit and the constant cross-sectional area portion of which a flow channel cross-sectional area is constant is formed in the jet water conduit on the upstream side of the narrowed portion, the flush water can be guided to the downstream side by the constant cross-sectional area portion while suppressing pressure loss due to contraction of the flow channel and, subsequently, the flush water can be spouted from the jet spout port by increasing flow velocity with the narrowed portion. Accordingly, sufficient jet spouting for discharging waste can be performed and waste discharge performance can be improved.

In the present invention, preferably, the flow channel cross-sectional area of the narrowed portion gradually contracts toward the jet spout port.

In the present invention configured in this manner, since the flow channel cross-sectional area of the narrowed portion gradually contracts toward the jet spout port, the flush water which passes through the narrowed portion can gradually increase its flow velocity toward the jet spout port.

In addition, in the present invention, preferably, the constant cross-sectional area portion is formed in the bending flow channel.

In the present invention configured in this manner, since the constant cross-sectional area portion is formed in the bending flow channel, pressure loss due to bending of the flow channel and pressure loss due to contraction of the flow channel can be prevented from concurrently occurring in the bending flow channel.

With the flush toilet according to the present invention, a siphon jet flush toilet which is capable of performing sufficient jet spouting for discharging waste and which enables waste discharge performance to be improved can be provided.

DETAILED DESCRIPTION OF THE INVENTION

Hereinafter, a flush toilet 1 according to a first embodiment of the present invention will be described.

First, a basic structure of the flush toilet 1 according to the first embodiment will be described with reference to FIGS. 1 and 2.

Figure 1:
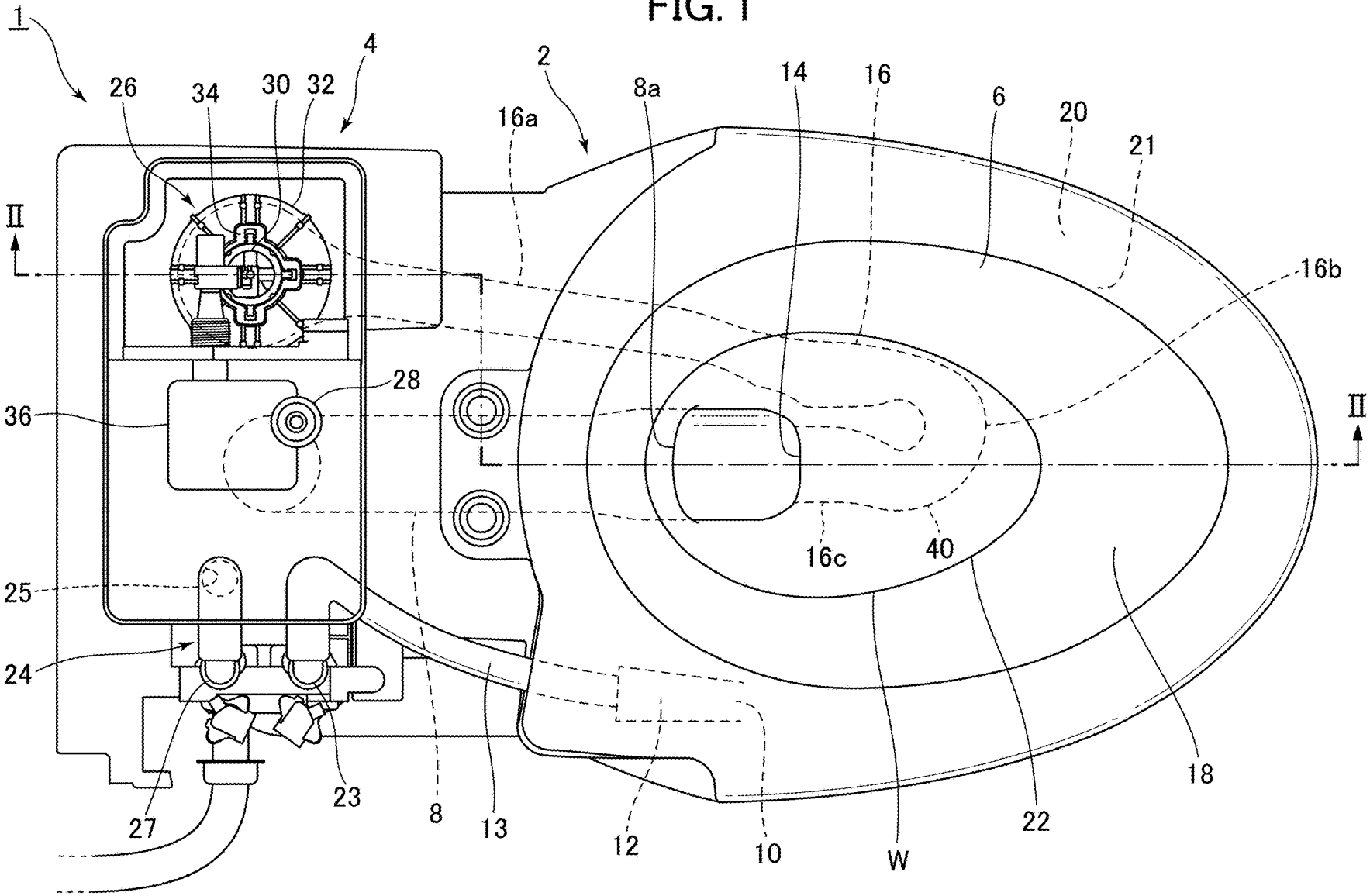
FIG. 1 is a plan view showing a flush toilet according to a first embodiment of the present invention.
Figure 2:
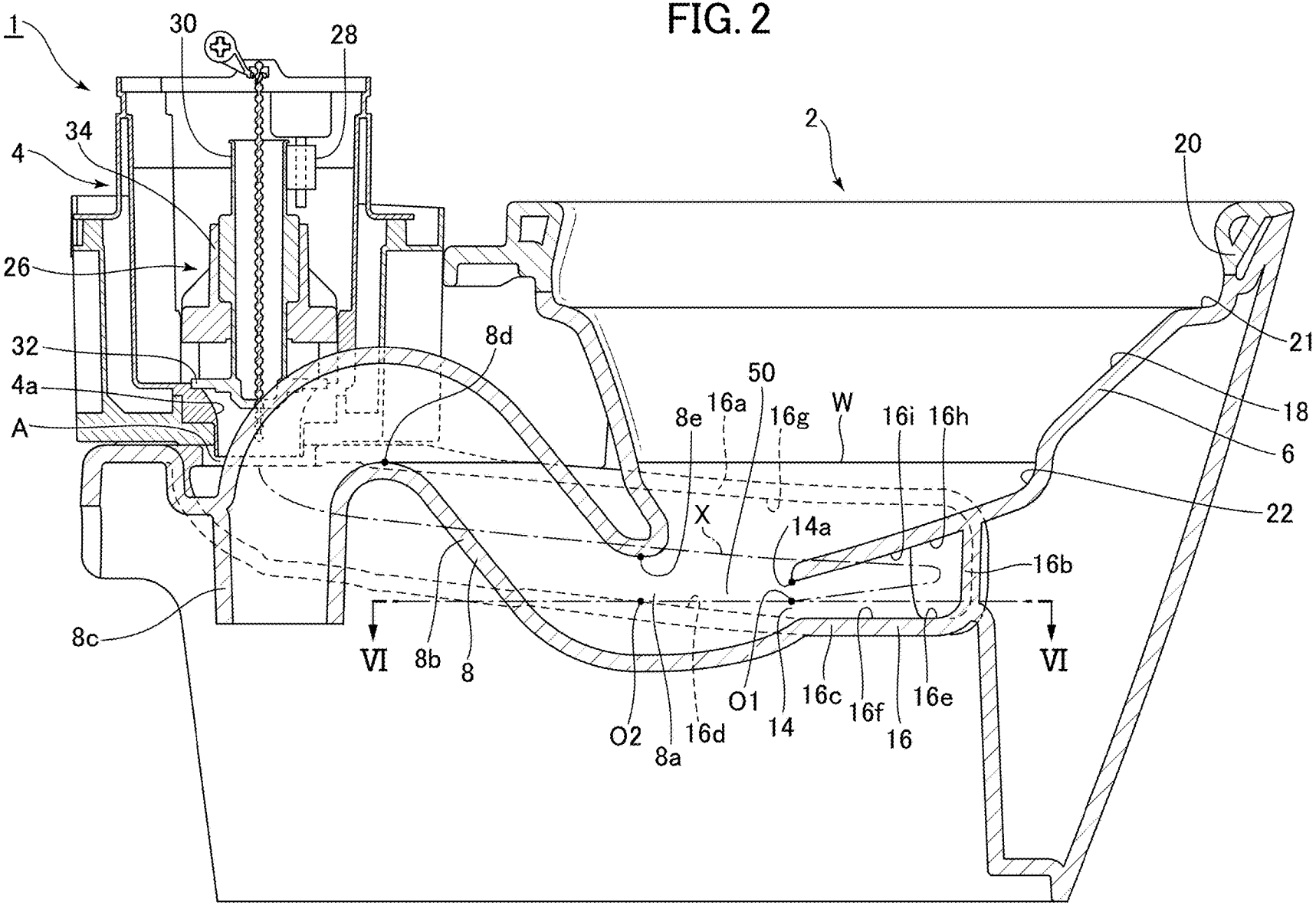
FIG. 2 is a side sectional view taken along line II-II in FIG. 1.

FIG. 1 is a plan view showing the flush toilet according to the first embodiment of the present invention, and FIG. 2 is a side sectional view taken along line II-II in FIG. 1.

As shown in FIGS. 1 and 2, the flush toilet 1 adopting a siphon jet according to the first embodiment is equipped with a ceramic toilet main body 2, a resin toilet seat and a resin toilet lid (not illustrated) which are arranged on an upper surface of the toilet main body 2, and a reservoir tank 4 which is arranged in an upper part to the rear of the toilet main body 2 and which is covered by a resin cover (not illustrated).

Formed in the toilet main body 2 are a bowl 6 which receives waste, a discharge trap conduit 8 which is provided in a bottom portion of the bowl 6 for discharging waste by a siphon action, a rim spout port 10 which performs rim spouting, a rim conduit 12 which supplies flush water to the rim spout port 10, a jet spout port 14 which performs jet spouting, and a jet water conduit 16 which supplies flush water to the jet spout port 14.

The bowl 6 is equipped with a bowl-shaped waste receiving surface 18, a rim 20 formed along a top edge portion of the bowl 6, and a shelf 21 formed between the waste receiving surface 18 and the rim 20. In addition, the bowl 6 is equipped with a well portion 22 which is formed in a region below the waste receiving surface 18 and inside which a seal water surface W is formed.

Furthermore, the bowl 6 is equipped with a buffer portion 50 which is formed below the well portion 22 (formed in the bottom portion of the bowl 6) and which communicates the jet spout port 14 and an inlet 8*a* of the discharge trap conduit 8 to each other.

The buffer portion 50 is a region positioned below the well portion 22 and between the jet spout port 14 and the inlet 8*a* of the discharge trap conduit 8.

The discharge trap conduit 8 is equipped with the inlet 8*a*, an ascending conduit 8*b* which extends upward from the inlet 8*a*, a descending conduit 8*c* which extends downward from the ascending conduit 8*b*, and a top portion 8*d* which is positioned between the descending conduit 8*c* and the ascending conduit 8*b* and which regulates a seal water level.

In this case, a lower end of the descending conduit 8*c* of the discharge trap conduit 8 is connected to a water discharge pipe (not illustrated) via a discharge socket (not illustrated).

The rim spout port 10 is formed at the rear on the left side of the rim 20 when the toilet main body 2 is viewed from the front. The rim spout port 10 spouts flush water toward the front and the flush water circulates on an inner circumference surface of the rim 20 and a shelf surface of the shelf 21 while flowing down toward the waste receiving surface 18.

The rim conduit 12 is formed in a tapered shape of which a flow channel cross section gradually decreases toward the rim spout port 10. A water supply hose 13 which is directly connected to tap water is connected to an upstream side of the rim conduit 12. Flush water is supplied from the tap water to the rim conduit 12 and the flush water is to be spouted from the rim spout port 10 due to water supply pressure of the tap water.

The jet spout port 14 is formed in the bottom portion of the bowl 6. The jet spout port 14 is arranged so as to oppose the inlet 8*a* of the discharge trap conduit 8 and is oriented toward the inlet 8*a* of the discharge trap conduit 8. The jet spout port 14 spouts flush water toward the inlet 8*a* of the discharge trap conduit 8 and the flush water flows into the discharge trap conduit 8 and starts a siphon action.

The jet water conduit 16 includes an upstream flow channel 16*a* which extends forward from the reservoir tank 4, a bending flow channel 16*b* which bends from the upstream flow channel 16*a*, and a downstream flow channel 16*c* which extends rearward from the bending flow channel 16*b* and which connects to the jet spout port 14. Flush water is supplied from the reservoir tank 4 to the jet water conduit 16 and the flush water is to be spouted from the jet spout port 14 due to head pressure of the flush water.

The reservoir tank 4 is a gravity fed tank which stores flush water to be used for jet spouting and which supplies the flush water to the jet spout port 14. The reservoir tank 4 is a small resin tank with a capacity of approximately 3 liters. An amount of flush water which is discharged from the reservoir tank 4 in one flush is approximately 2 liters. A lower part of the reservoir tank 4 is arranged lower than an upper surface of the rim 20 of the toilet main body 2 and higher than the top portion 8*d* of the discharge trap conduit 8. Accordingly, the flush toilet 1 is a low silhouette type toilet.

Note that a flush water supply source which supplies flush water to the jet spout port 14 is not limited to the gravity fed reservoir tank described in the present embodiment and a reservoir tank equipped with a pump such as a pressurizing pump, a jet pump, or an accumulator pump may be used.

A water supply device 24 which supplies flush water to the reservoir tank 4, a discharge device 26 which supplies or stops supplying the flush water stored in the reservoir tank 4 to the jet water conduit 16, and a float switch 28 which detects a state where a water level of the flush water in the reservoir tank 4 has reached a stopped water level (full water level) are provided in the reservoir tank 4. In addition, a controller (not illustrated) which controls the water supply device 24 and the discharge device 26 so as to be driven or stopped based on an operation signal of a user and an operation unit (not illustrated) which transmits an operation signal according to an operation by the user are provided outside the reservoir tank 4.

The water supply device 24 is equipped with a fixed flow valve (not illustrated) connected to tap water, a rim-side electromagnetic valve 23 which supplies or stops supplying flush water to the rim spout port 10, and a tank-side electromagnetic valve 27 which supplies or stops supplying flush water to a tank water supply port 25 arranged in the reservoir tank 4. The rim-side electromagnetic valve 23 and the tank-side electromagnetic valve 27 are configured to be driven by a command of the controller based on an operation signal of the user or a water level detection signal by the float switch 28.

The discharge device 26 is equipped with an overflow pipe 30 which discharges overflowing water in the reservoir tank 4 to the toilet main body 2, a discharge valve 32 which is fixed to a lower end portion of the overflow pipe 30, and a toilet washing unit 36 which opens and closes the discharge valve 32 by moving the overflow pipe 30 up and down using an electrical driving force. In addition, a guiding member 34 which guides upward and downward movement of the discharge valve 32 is attached to a periphery of a discharge port 4*a* of the reservoir tank 4. The toilet washing unit 36 is configured to be driven by a command of the controller based on an operation signal of the user.

Note that the discharge device is not limited to the discharge valve described in the present embodiment and a pressurizing pump, a jet pump, an accumulator pump, or the like may be used in place of the discharge valve.

The controller is electrically connected to the operation unit, the float switch 28, the rim-side electromagnetic valve 23, the tank-side electromagnetic valve 27, and the toilet washing unit 36 and is capable of transmitting and receiving various signals. The controller is configured to receive a flush start signal of a large flush or a small flush from the operation unit and to drive or stop driving the rim-side electromagnetic valve 23, the tank-side electromagnetic valve 27, and the toilet washing unit 36 based on a flush sequence stored in advance. A flush water amount is set to approximately 4.8 liters for a large flush and approximately 3.8 liters for a small flush.

Next, the jet water conduit 16 of the flush toilet according to the first embodiment will be described in detail with reference to FIGS. 1 to 4.

Figure 3:
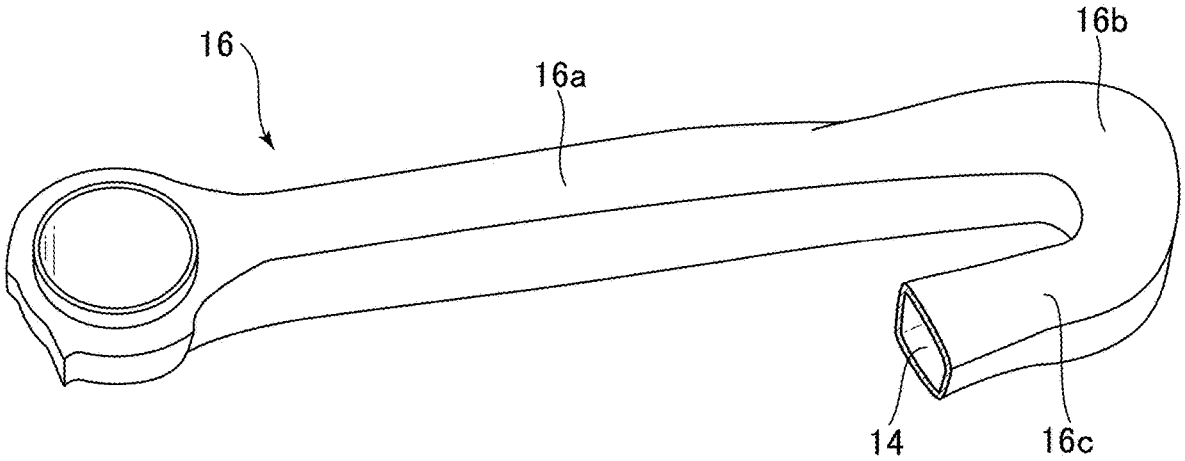
FIG. 3 is a perspective view showing an entire jet water conduit according to the first embodiment of the present invention.
Figure 4:
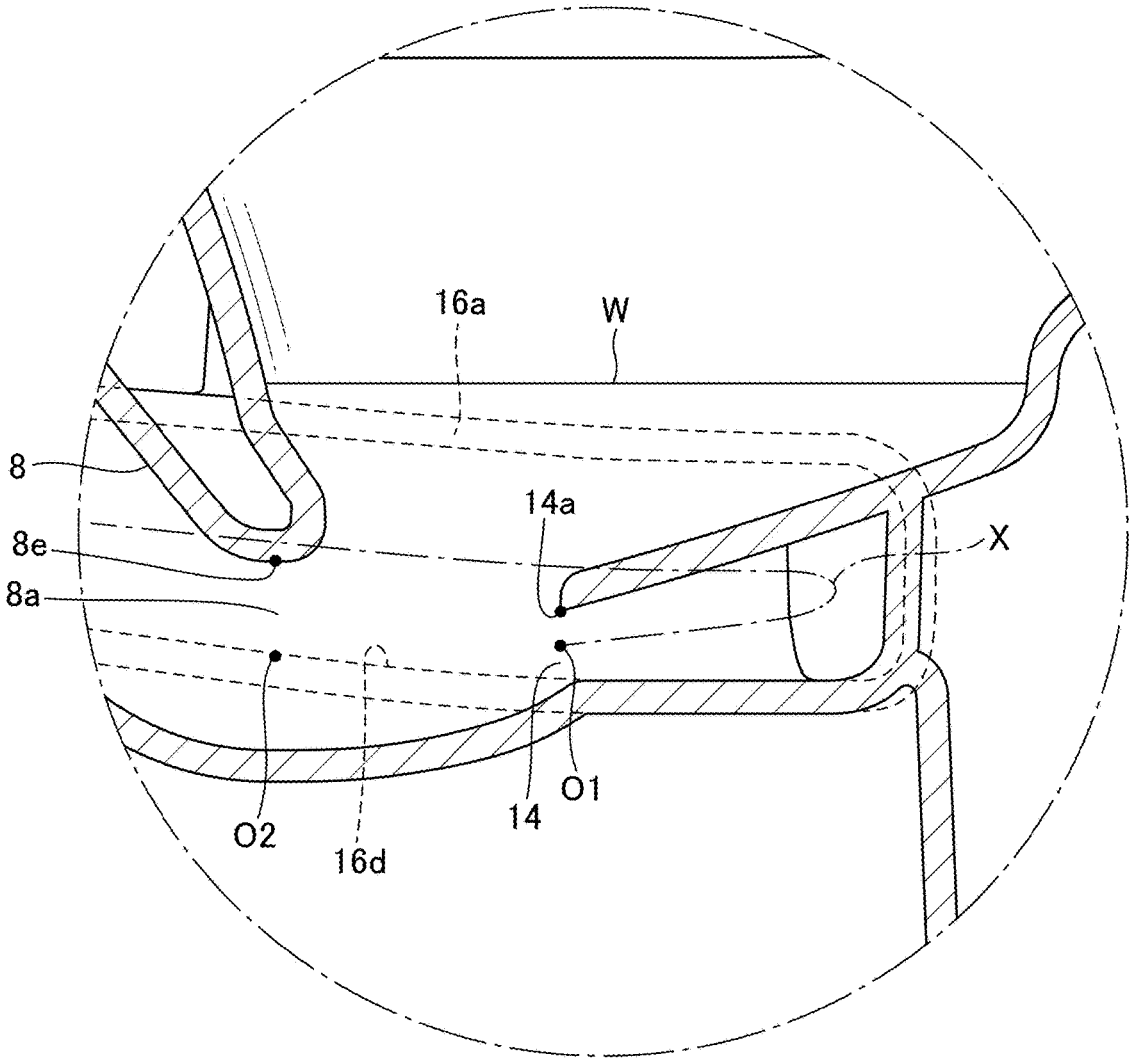
FIG. 4 is a partial enlarged view which enlarges a portion of a jet spout port of the flush toilet according to the first embodiment of the present invention shown in FIG. 2.

FIG. 3 is a perspective view showing the entire jet water conduit according to the first embodiment, and FIG. 4 is a partial enlarged view which enlarges a portion of the jet spout port of the flush toilet according to the first embodiment shown in FIG. 2.

First, as shown in FIG. 1, the jet water conduit 16 is formed in a U shape as a whole. One end of the jet water conduit 16 is connected to the discharge port 4*a* of the reservoir tank 4 arranged on a right side and another end of the jet water conduit 16 is connected to the jet spout port 14 arranged at center in a left-right direction. The upstream flow channel 16*a* of the jet water conduit 16 extends toward the front from the discharge port 4*a* of the reservoir tank 4 while being approximately parallel to the discharge trap conduit 8. In addition, the bending flow channel 16*b* of the jet water conduit 16 bends (makes a U-turn) toward the rear from a downstream end of the upstream flow channel 16*a*.

Furthermore, the downstream flow channel 16*c* of the jet water conduit 16 extends to the rear from a downstream end of the bending flow channel 16*b* toward the inlet 8*a* of the discharge trap conduit 8.

Next, as shown in FIG. 2, with the exception of a partial region A (a region in a vicinity of the discharge port 4*a* of the reservoir tank 4) of the upstream flow channel 16*a* positioned directly below the reservoir tank 4, the jet water conduit 16 is arranged lower than the top portion 8*d* of the discharge trap conduit 8 or, in other words, lower than the seal water surface W. In addition, as shown in FIG. 3, a vertical width and a horizontal width of the flow channel cross section of the jet water conduit 16 are made larger than conventional products and, accordingly, a capacity of the jet water conduit as a whole is increased. Specifically, the jet water conduit 16 has a capacity (approximately 1 liter) that is ⅓ or more of a capacity (approximately 3 liters) of the reservoir tank 4. Furthermore, the jet water conduit 16 has a capacity (approximately 1 liter) that is half or more of an amount (approximately 2 liters) of flush water that is discharged from the reservoir tank 4 in one flush. Accordingly, as compared to conventional products, a larger amount of flush water can be retained in the jet water conduit 16 and jet spouting can be performed by head pressure of the retained flush water.

Note that the present invention is not limited to a toilet in which the entire jet water conduit 16 is arranged lower than the top portion 8*d* of the discharge trap conduit 8 and the present invention includes a toilet in which a part of the jet water conduit 16 is arranged higher than the top portion 8*d* as in the present embodiment.

Furthermore, as shown in FIG. 4, a bottom surface 16*d* on a downstream side of the upstream flow channel 16*a* is positioned lower than an upper end 8*e* of the inlet 8*a* of the discharge trap conduit 8. Moreover, the bottom surface 16*d* is positioned lower than the upper end 8*e* of the inlet 8*a* of the discharge trap conduit 8 on a forward side of the top portion 8*d* of the discharge trap conduit 8 (refer to FIG. 2). Accordingly, even when the seal water level drops and the siphon action almost ends, since flush water is continuously retained on the downstream side of the upstream flow channel 16*a*, the siphon action can be continued.

Next, a center O1 of the jet spout port 14 is arranged at approximately a same height position as a center O2 of the inlet 8*a* of the discharge trap conduit 8. Accordingly, flush water which is spouted from the jet spout port 14 readily flows into the inlet 8*a* of the discharge trap conduit 8. Furthermore, the center O1 of the jet spout port 14 is arranged at a lowermost position of a center axis X in the flow channel cross section of the jet water conduit 16 (refer to FIG. 2). Accordingly, since the center O1 of the jet spout port 14 is arranged at the lowermost position, flush water can be spouted over a long period of time from the jet spout port 14 and, therefore, penetration of air into the jet water conduit 16 from the jet spout port 14 can be delayed.

Furthermore, an upper end 14*a* of the jet spout port 14 is arranged lower than the upper end 8*e* of the inlet 8*a* of the discharge trap conduit 8. Accordingly, since flush water is spouted over a long period of time from the jet spout port 14, the siphon action can be continued. As shown in FIG. 2, half or more of the jet water conduit 16 is positioned higher than the upper end 8*e* of the inlet 8*a* of the discharge trap conduit 8. Accordingly, approximately all of the flush water in the jet water conduit can be discharged before the siphon action ends. In addition, upper surfaces 16*g*, 16*h*, and 16*i* and the bottom surface 16*d* of the jet water conduit 16 are gradually inclined downward from the upstream side toward the downstream side. Accordingly, flush water readily flows toward the jet spout port 14.

Next, a downstream portion of the jet water conduit 16 of the flush toilet according to the first embodiment will be described in detail with reference to FIG. 1 and FIGS. 5 to 7G.

Figure 5:
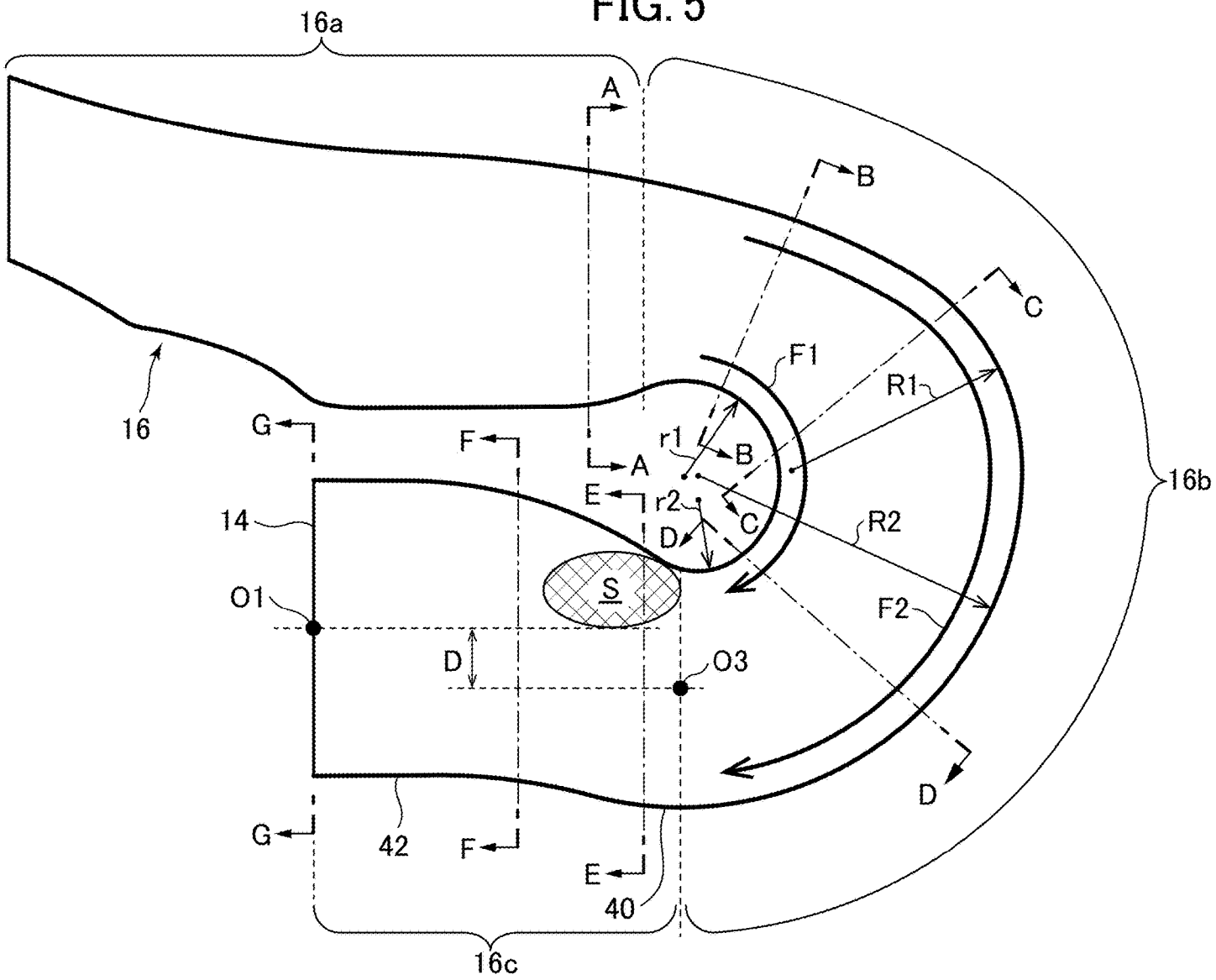
FIG. 5 is a plan sectional view of a downstream portion of the jet water conduit of the flush toilet according to the first embodiment of the present invention shown in FIG. 1.
Figure 6:
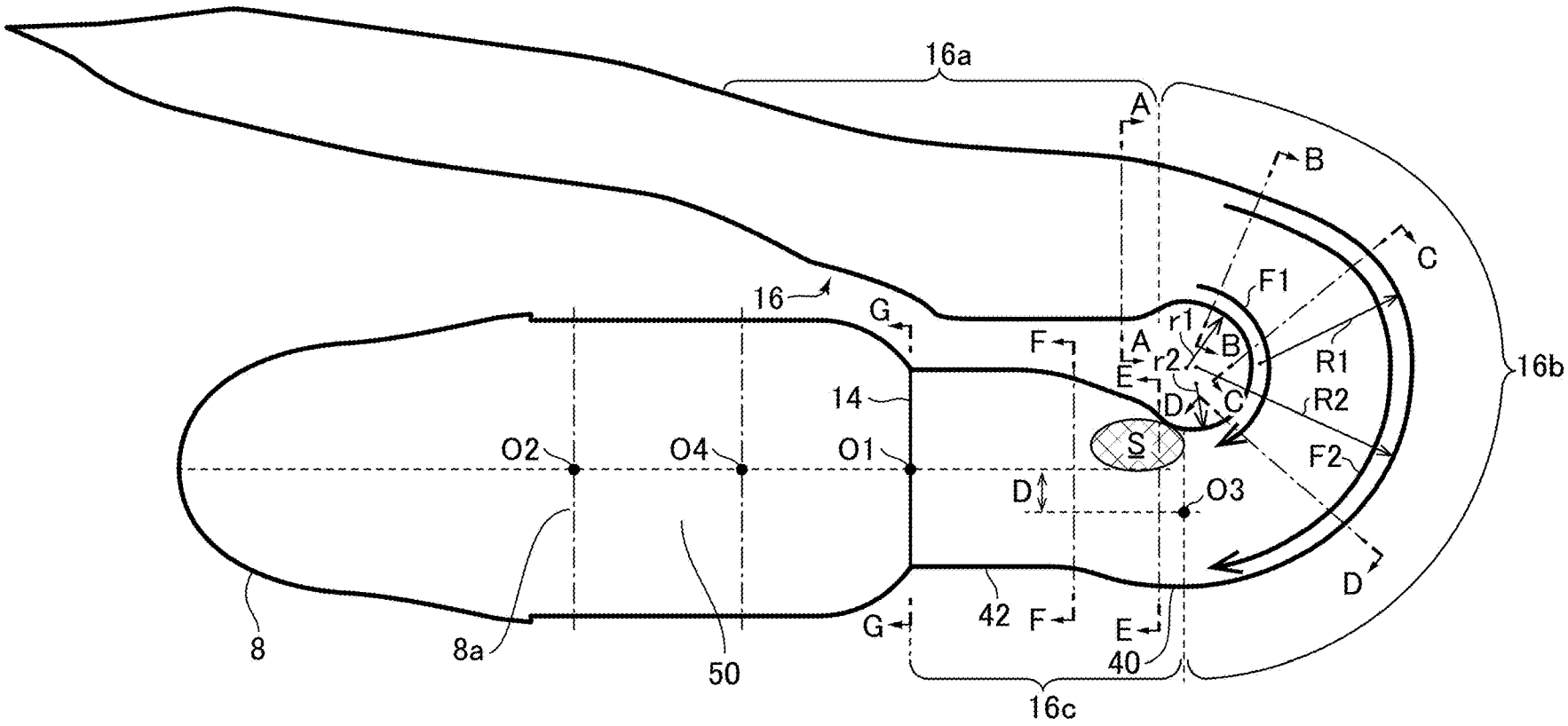
FIG. 6 is a plan sectional view taken along line VI-VI in FIG. 2.

FIG. 5 is a plan sectional view of the downstream portion of the jet water conduit of the flush toilet according to the first embodiment of the present invention shown in FIG. 1, FIG. 6 is a plan sectional view taken along line VI-VI in FIG. 2, and FIGS. 7A to 7G are views showing flow channel cross sections A to G of the jet water conduit of the flush toilet according to the first embodiment shown in FIGS. 5 and 6.

First, as shown in FIG. 5, a curved portion 40 which is eccentrically positioned on an opposite side to the upstream flow channel 16*a* with respect to a center axis of the jet spout port 14 (the center O1 of the jet spout port 14) in a top view is formed in the downstream flow channel 16*c* and the bending flow channel 16*b* of the jet water conduit 16. An eccentric distance D between the center O1 of the jet spout port 14 and a center O3 in a flow channel cross section of a downstream end of the bending flow channel 16*b* is set to approximately 9 mm. In addition, as shown in FIG. 6, the center O1 of the jet spout port 14 is set to be coaxial with respect to a center O4 of the flow channel cross section of the buffer portion 50 and the center O2 of the inlet 8*a* of the discharge trap conduit 8.

Due to the curved portion 40, a flow velocity distribution of flush water which is spouted from the jet spout port 14 is adjusted and the flow velocity distribution in the flow channel cross section of the jet spout port 14 becomes approximately uniform. In addition, due to the curved portion 40, a flow velocity distribution of flush water which is spouted from the jet spout port 14 is adjusted and the flush water which is spouted from the jet spout port 14 is to flow toward the center O2 of the inlet 8*a* of the discharge trap conduit 8.

Next, as shown in FIG. 5, the curved portion 40 is arranged in an inside region (in a seal water region) of the seal water surface W in a top view and the entire bending flow channel 16*b* is also arranged in the inside region of the seal water surface W. Accordingly, the curved portion 40 and the bending flow channel 16*b* of the jet water conduit 16 are compactly formed. In addition, since the curved portion 40 and the bending flow channel 16*b* are arranged in the inside region of the seal water surface W, the curved portion 40 and the bending flow channel 16*b* can be constantly filled with water and retention of air inside the curved portion 40 and the bending flow channel 16*b* can be suppressed.

Furthermore, as shown in FIG. 5, a rectifying portion 42 which extends rearward toward the jet spout port 14 is formed in the downstream flow channel 16*c* on a downstream side of the curved portion 40. The rectifying portion 42 extends approximately linearly over a length of approximately 25 mm toward the jet spout port 14. Accordingly, flush water after flowing through the curved portion 40 can be rectified.

Next, an inner circumference surface of the bending flow channel 16*b* is formed of a curvature radius r1 on the upstream side and a curvature radius r2 on the downstream side and the downstream-side curvature radius r2 is made smaller than the upstream-side curvature radius r1. In addition, an outer circumference surface of the bending flow channel 16*b* is formed of a curvature radius R1 on the upstream side and a curvature radius R2 on the downstream side and the downstream-side curvature radius R2 is made larger than the upstream-side curvature radius R1.

In this case, flush water F1 which flows over the inner circumference surface of the bending flow channel 16*b* separates from the inner circumference surface under an effect of centrifugal force and stagnation S inevitably occurs in a vicinity of the inner circumference surface on the downstream side of the bending flow channel 16*b* (refer to FIG. 5). As a result, an effect of energy loss is small even when the curvature radius of the inner circumference surface on the downstream side of the bending flow channel 16*b* is reduced. Therefore, since the inner circumference surface on the downstream side of the bending flow channel 16*b* which is a portion where the stagnation S occurs is formed by a relatively small curvature radius r2, the bending flow channel 16*b* can be made compact while suppressing an occurrence of energy loss in the flush water that flows through the bending flow channel 16*b*.

In addition, flush water F2 which flows over the outer circumference surface of the bending flow channel 16*b* is subjected to the effect of centrifugal force and a flow rate thereof is relatively larger than that of the flush water F1. Since the outer circumference surface on the downstream side of the bending flow channel 16*b* where a relatively large amount of the flush water F2 flows has a relatively large curvature radius R2, the flush water can be allowed to flow over the outer circumference surface while maintaining its flow velocity and an occurrence of flow separation on the outer circumference surface of the bending flow channel 16*b* can be suppressed.

Furthermore, the jet water conduit 16 is molded by cast molding (double molding) in which a space between the upstream flow channel 16*a* and the rectifying portion 42 of the downstream flow channel 16*c* produces a solid compact. Accordingly, the space between the upstream flow channel 16*a* and the rectifying portion 42 of the downstream flow channel 16*c* can be made thin and the jet water conduit 16 can be made compact.

As shown in FIG. 2 and FIGS. 7A to 7G, the bottom surface 16*d* of the upstream flow channel 16*a* of the jet water conduit 16 is formed inclined downward from the upstream side toward the downstream side and a bottom surface 16*e* of the bending flow channel 16*b* and a bottom surface 16*f* of the downstream flow channel 16*c* are formed approximately horizontal at approximately same height positions.

As shown in FIG. 2, the upper surface 16*g* of the upstream flow channel 16*a*, the upper surface 16*h* of the bending flow channel 16*b*, and the upper surface 16*i* of the downstream flow channel 16*c* of the jet water conduit 16 are formed inclined downward from the upstream side toward the downstream side.

Figure 7A:
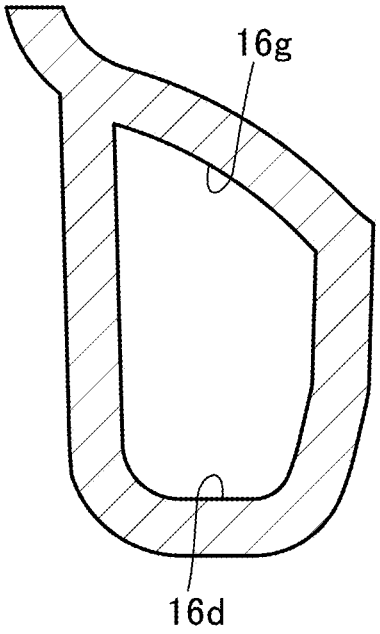
FIG. 7A is a view showing a flow channel cross section A of the jet water conduit of the flush toilet according to the first embodiment of the present invention shown in FIGS. 5 and 6.
Figure 7B:
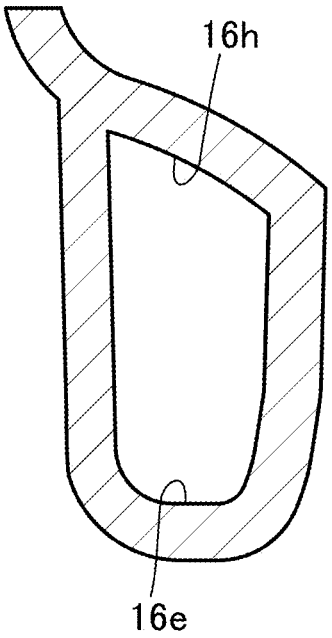
FIG. 7B is a view showing a flow channel cross section B of the jet water conduit of the flush toilet according to the first embodiment of the present invention shown in FIGS. 5 and 6.
Figure 7C:
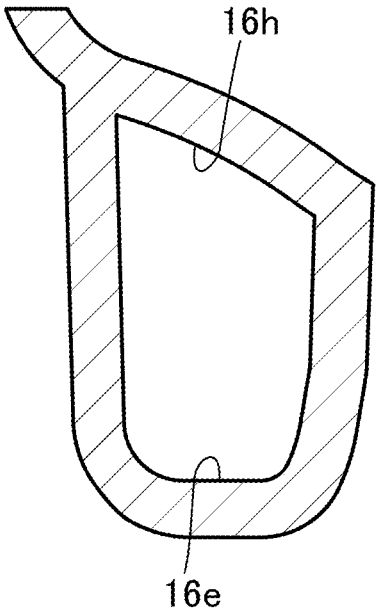
FIG. 7C is a view showing a flow channel cross section C of the jet water conduit of the flush toilet according to the first embodiment of the present invention shown in FIGS. 5 and 6.
Figure 7D:
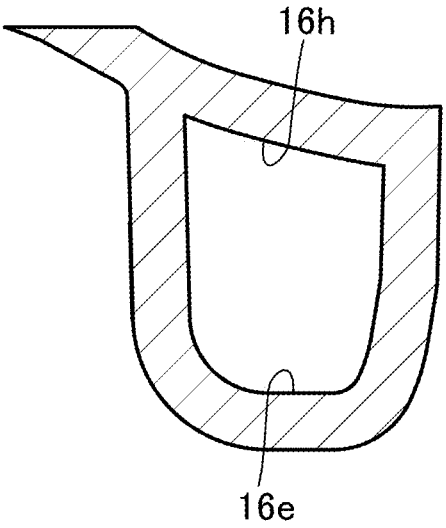
FIG. 7D is a view showing a flow channel cross section D of the jet water conduit of the flush toilet according to the first embodiment of the present invention shown in FIGS. 5 and 6.
Figure 7E:
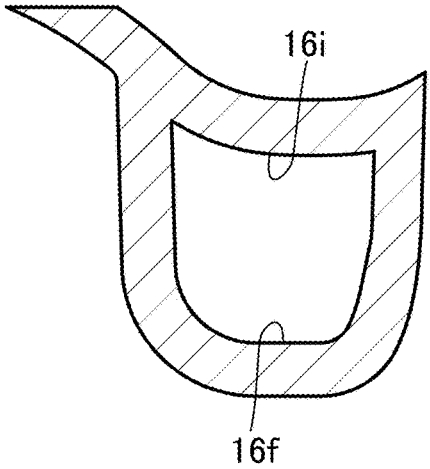
FIG. 7E is a view showing a flow channel cross section E of the jet water conduit of the flush toilet according to the first embodiment of the present invention shown in FIGS. 5 and 6.
Figure 7F:
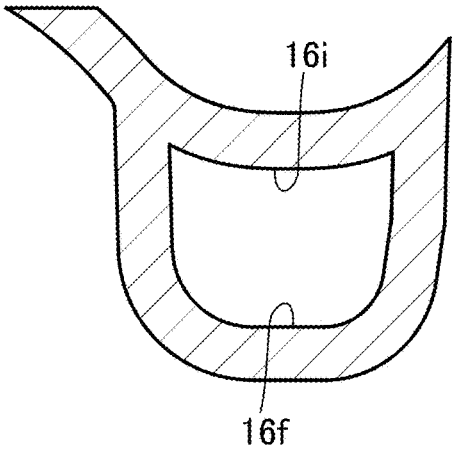
FIG. 7F is a view showing a flow channel cross section F of the jet water conduit of the flush toilet according to the first embodiment of the present invention shown in FIGS. 5 and 6.
Figure 7G:
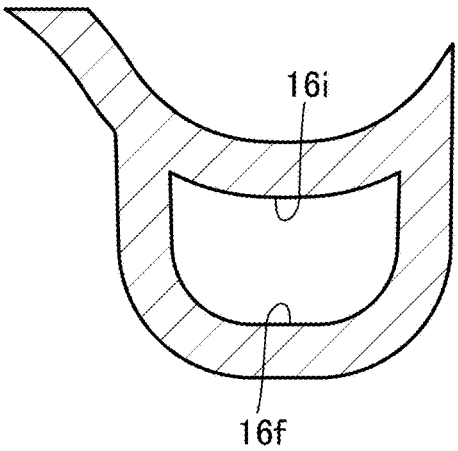
FIG. 7G is a view showing a flow channel cross section G of the jet water conduit of the flush toilet according to the first embodiment of the present invention shown in FIGS. 5 and 6.

As shown in FIGS. 7B to 7D, a height position of the upper surface 16*h* of the bending flow channel 16*b* is higher on a side of the outer circumference surface than on a side of the inner circumference surface. Accordingly, the side of the outer circumference surface can be formed larger than the side of the inner circumference surface in a flow channel cross-sectional area of the bending flow channel 16*b* and separation of the flush water F2 that flows over the outer circumference surface of the bending flow channel 16*b* from the outer circumference surface of the bending flow channel 16*b* can be suppressed. In addition, as shown in FIGS. 7F and 7G, in a height dimension of the rectifying portion 42 of the downstream flow channel 16*c*, a side of the inner circumference surface and a side of the outer circumference surface are formed of approximately the same height dimension. Accordingly, flush water can be further rectified.

As shown in FIGS. 7B to 7G, in the flow channel cross sections of the bending flow channel 16*b* and the downstream flow channel 16*c*, a horizontal width gradually increases while a vertical width gradually decreases from the upstream side toward the downstream side. Accordingly, a flat flow with a large flow rate can be spouted from the jet spout port 14.

Next, a flush operation of the flush toilet 1 according to the first embodiment of the present invention will be described with reference to FIGS. 8A to 8F.

FIGS. 8A to 8F are views for explaining the flush operation of the flush toilet according to the first embodiment of the present invention.

Figure 8A:
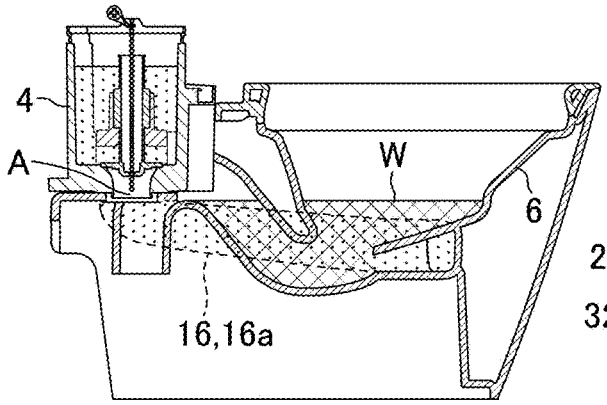
FIG. 8A is a view for explaining a flush operation of the flush toilet according to the first embodiment of the present invention.

FIG. 8A shows a standby state where flush water is stored up to a water level of the seal water surface W in the bowl 6 and flush water is also stored up to a same height position as the seal water surface W in the jet water conduit 16. At this point, air is retained in a partial region A of the upstream flow channel 16*a* which is positioned directly below the reservoir tank 4.

Figure 8B:
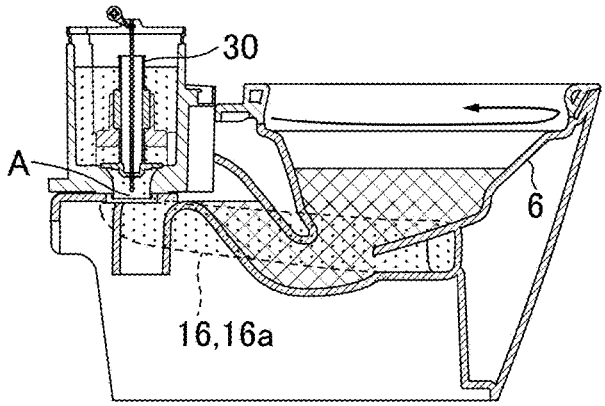
FIG. 8B is a view for explaining the flush operation of the flush toilet according to the first embodiment of the present invention.

Next, as shown in FIG. 8B, the water supply device is driven (the rim-side electromagnetic valve opens), rim spouting is started, and the water level of the flush water gradually rises in the bowl 6. Accordingly, the water level of the flush water also gradually rises in the jet water conduit 16 and the air having been retained in the partial region A of the upstream flow channel 16*a* is discharged from the overflow pipe 30 and the jet water conduit 16 becomes filled with water.

Figure 8C:
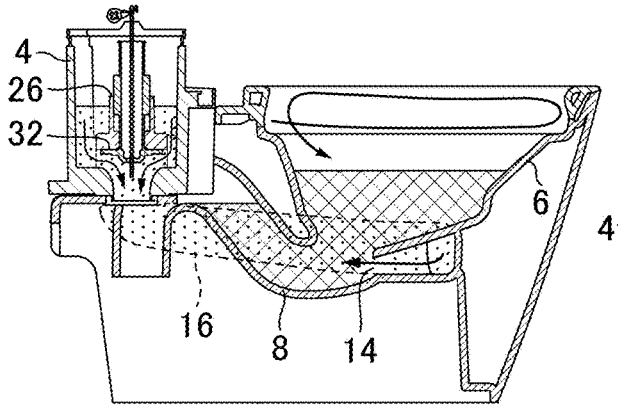
FIG. 8C is a view for explaining the flush operation of the flush toilet according to the first embodiment of the present invention.

Subsequently, as shown in FIG. 8C, the discharge device 26 is driven (the discharge valve 32 opens) while rim spouting is in progress and jet spouting is started. At this point, the flush water retained in the jet water conduit 16 is subjected to head pressure of the flush water stored in the reservoir tank 4 and a first flow rate is spouted from the jet spout port 14. The first flow rate is a large flow rate and, due to the jet spouting of the first flow rate, the discharge trap conduit 8 is filled with water and a siphon action is started. The jet spouting of the first flow rate is continued for a predetermined period of time and waste is discharged by a strong siphon action.

Figure 8D:
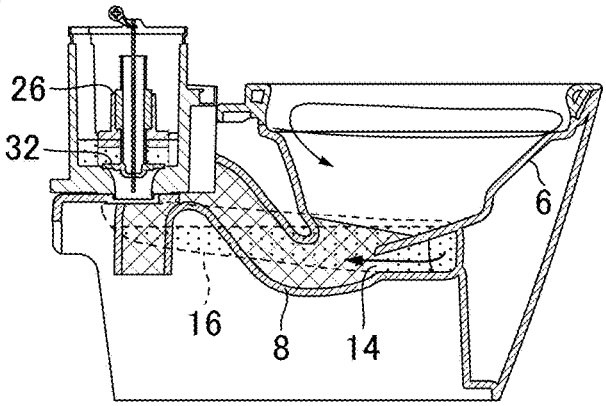
FIG. 8D is a view for explaining the flush operation of the flush toilet according to the first embodiment of the present invention.

Next, as shown in FIG. 8D, the discharge device 26 stops (the discharge valve 32 closes) while rim spouting is in progress. Even when the discharge device 26 stops, a large amount of flush water is retained in the jet water conduit 16 since a capacity of the jet water conduit 16 as a whole is large and, due to the flush water flowing through the jet water conduit 16 while receiving head pressure of the retained flush water, a second flow rate is spouted from the jet spout port 14. Although being a smaller flow rate than the first flow rate, the second flow rate is a sufficient flow rate for continuing the siphon action. The jet spouting of the second flow rate is continued for a predetermined period of time and the siphon action is continued.

Figure 8E:
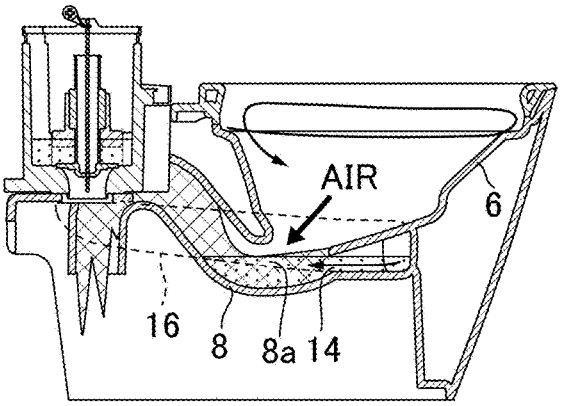
FIG. 8E is a view for explaining the flush operation of the flush toilet according to the first embodiment of the present invention.

Subsequently, as shown in FIG. 8E, the water level of the flush water in the bowl 6 drops due to seal water being discharged together with waste by the siphon action, air penetrates from the upper end of the inlet 8*a* of the discharge trap conduit 8, and the siphon action ends. In this case, since the jet water conduit 16 is formed so as to continuously retain flush water, the penetration of air can be delayed and the end of the siphon action can be delayed. Rim spouting is continuously performed and, once the flush water is stored up to the water level of the seal water surface W in the bowl 6, the flush ends. At this point, flush water is also stored up to a same height position as the seal water surface W in the jet water conduit 16.

Figure 8F:
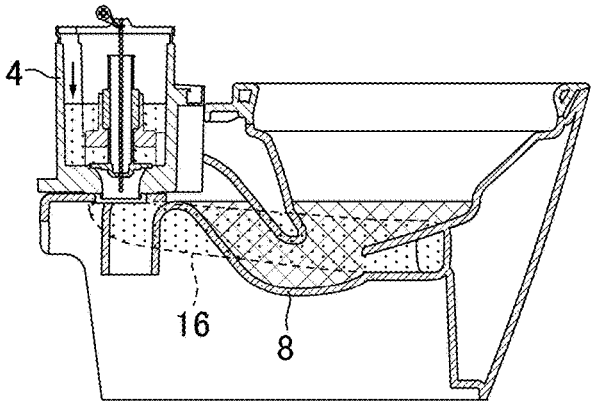
FIG. 8F is a view for explaining the flush operation of the flush toilet according to the first embodiment of the present invention.

Next, as shown in FIG. 8F, the water supply device is driven (the tank-side electromagnetic valve opens) and tank water supply is started. Once the water level of the flush water in the reservoir tank 4 rises and the float switch detects a state of a stopped water level (full water level), the water supply device stops (the tank-side electromagnetic valve closes) and, subsequently, the original standby state is restored as shown in FIG. 8A.

Next, details of a jet spouting mode of the flush toilet according to the first embodiment of the present invention will be described with reference to FIGS. 9A and 9B.

Figure 9A:
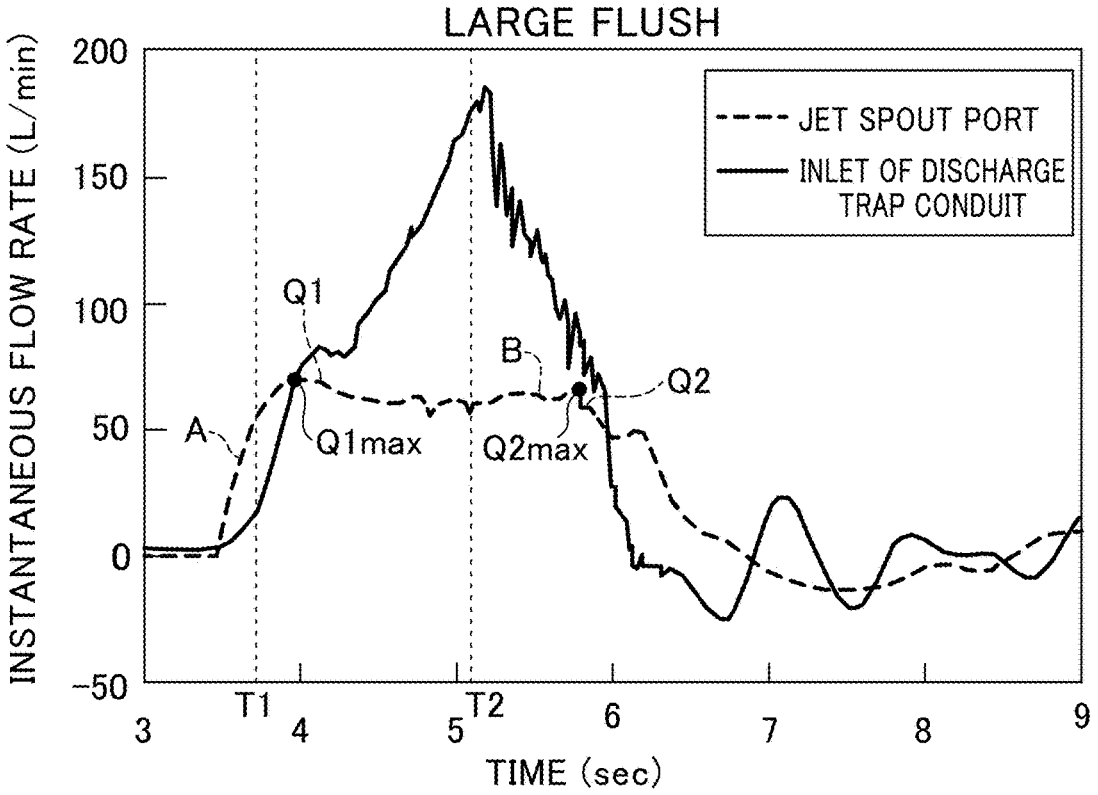
FIG. 9A is a diagram showing an instantaneous flow rate of flush water which is spouted from the jet spout port and an instantaneous flow rate of flush water flowing into an inlet of a discharge trap conduit during a large flush of the flush toilet according to the first embodiment of the present invention.
Figure 9B:
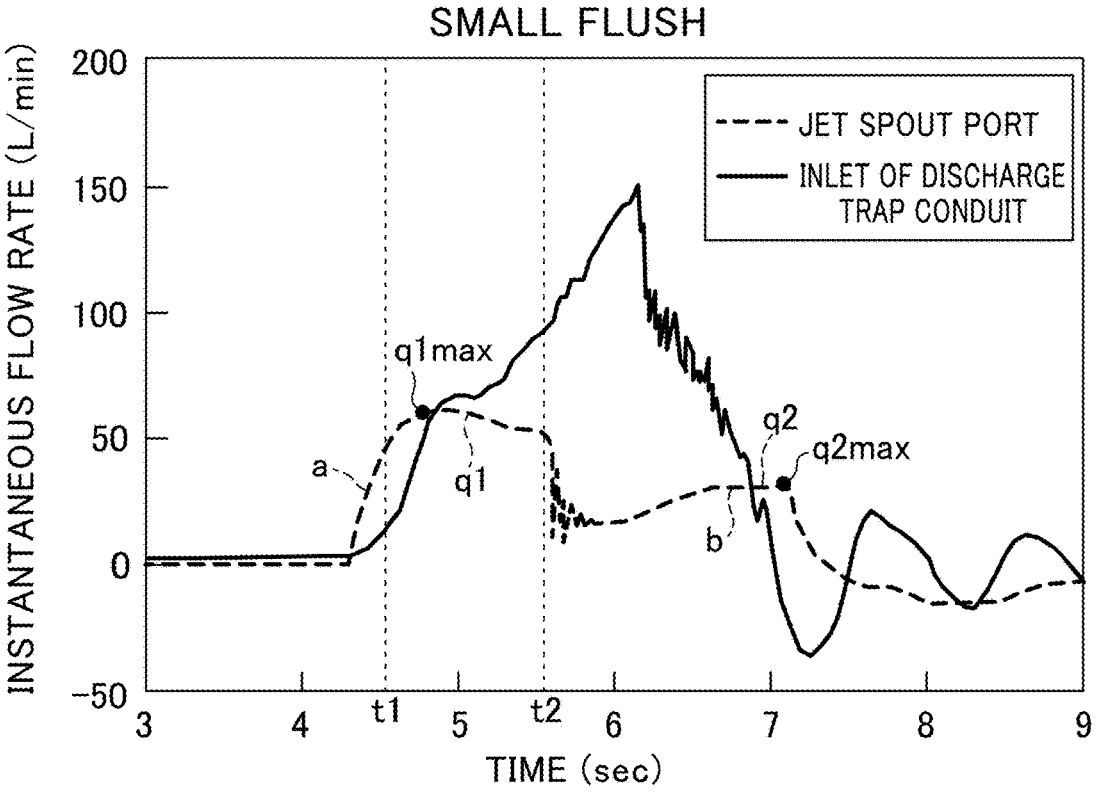
FIG. 9B is a diagram showing an instantaneous flow rate of flush water which is spouted from the jet spout port and an instantaneous flow rate of flush water flowing into the inlet of the discharge trap conduit during a small flush of the flush toilet according to the first embodiment of the present invention.

FIG. 9A is a diagram showing an instantaneous flow rate of flush water which is spouted from the jet spout port and an instantaneous flow rate of flush water flowing into the inlet of the discharge trap conduit during a large flush of the flush toilet according to the first embodiment of the present invention, and FIG. 9B is a diagram showing an instantaneous flow rate of flush water which is spouted from the jet spout port and an instantaneous flow rate of flush water flowing into the inlet of the discharge trap conduit during a small flush of the flush toilet according to the first embodiment of the present invention. Dashed lines in FIGS. 9A and 9B represent an instantaneous flow rate of flush water which is spouted from the jet spout port 14 and solid lines in FIGS. 9A and 9B represent an instantaneous flow rate of flush water which flows into the inlet 8*a* of the discharge trap conduit 8.

In the present embodiment, the flush water amount which is spouted from the jet spout port 14 is approximately 2 liters for a large flush and approximately 1.5 liters for a small flush.

In a large flush, as shown in FIG. 9A, first, when the discharge device 26 is driven, jet spouting starts and a first flow rate Q1 is spouted from the jet spout port 14. At this point, the instantaneous flow rate of the flush water which is spouted from the jet spout port 14 rapidly increases (increasing rate A) immediately after start and promptly reaches a maximum instantaneous flow rate Q1*max*. Accordingly, a siphon action is quickly started (time T1). Subsequently, the instantaneous flow rate slightly decreases from the maximum instantaneous flow rate Q1*max* and becomes approximately constant. In addition, the instantaneous flow rate of the flush water which flows into the inlet 8*a* of the discharge trap conduit 8 rapidly increases due to seal water being drawn into the discharge trap conduit 8 by the siphon action in addition to the flush water which is spouted from the jet spout port 14 and the rim spout port 10. Accordingly, a strong siphon action can be started and continued.

Next, as shown in FIG. 9A, after the discharge device 26 stops (time T2), when spouting of the first flow rate Q1 ends, a second flow rate Q2 is spouted from the jet spout port 14. At this point, the instantaneous flow rate of the flush water which is spouted from the jet spout port 14 gradually increases (increasing rate B) as compared to the increasing rate A of the first flow rate Q1 and reaches a maximum instantaneous flow rate Q2*max*. Accordingly, the flush water which is spouted from the jet spout port 14 can be prevented from being disturbed.

In addition, the maximum instantaneous flow rate Q2*max* of the second flow rate Q2 is set smaller than the maximum instantaneous flow rate Q1*max* of the first flow rate Q1. Accordingly, the siphon action can be continued by the second flow rate Q2 which is smaller than the first flow rate Q1 and both an improvement in waste discharge performance and water conservation can be achieved. Furthermore, since seal water is drawn into the discharge trap conduit 8 by the siphon action in addition to the flush water which is spouted from the jet spout port 14 and the rim spout port 10, the instantaneous flow rate of the flush water which flows into the inlet 8*a* of the discharge trap conduit 8 can be maintained at a large instantaneous flow rate.

In a small flush, as shown in FIG. 9B, first, when the discharge device 26 is driven, jet spouting starts and a first flow rate q1 is spouted from the jet spout port 14. At this point, the instantaneous flow rate of the flush water which is spouted from the jet spout port 14 rapidly increases (increasing rate a) immediately after start and promptly reaches a maximum instantaneous flow rate q1*max*. Accordingly, a siphon action is quickly started (time t1). Subsequently, the instantaneous flow rate slightly decreases from the maximum instantaneous flow rate q1*max* and, when the discharge device 26 subsequently stops (time t2), the instantaneous flow rate rapidly decreases. In addition, the instantaneous flow rate of the flush water which flows into the inlet 8*a* of the discharge trap conduit 8 rapidly increases due to seal water being drawn into the discharge trap conduit 8 by the siphon action in addition to the flush water which is spouted from the jet spout port 14 and the rim spout port 10. Accordingly, a strong siphon action can be started and continued.

Next, as shown in FIG. 9B, after the discharge device 26 stops (time t2), when spouting of the first flow rate q1 ends, a second flow rate q2 is spouted from the jet spout port 14. At this point, the instantaneous flow rate of the flush water which is spouted from the jet spout port 14 gradually increases (increasing rate b) as compared to the increasing rate a of the first flow rate q1 and reaches a maximum instantaneous flow rate q2*max*. Accordingly, the flush water which is spouted from the jet spout port 14 can be prevented from being disturbed.

In addition, the maximum instantaneous flow rate q2*max* of the second flow rate q2 is set smaller than the maximum instantaneous flow rate q1*max* of the first flow rate q1. Accordingly, the siphon action can be continued by the second flow rate q2 which is smaller than the first flow rate q1 and both an improvement in waste discharge performance and water conservation can be achieved. Furthermore, since seal water is drawn into the discharge trap conduit 8 by the siphon action in addition to the flush water which is spouted from the jet spout port 14 and the rim spout port 10, the instantaneous flow rate of the flush water which flows into the inlet 8*a* of the discharge trap conduit 8 can be maintained at a large instantaneous flow rate.

A comparison between a large flush and a small flush reveals that, as shown in FIGS. 9A and 9B, a flush water amount is switched between a large flush and a small flush by adjusting jet spouting times by the first flow rate Q1 of a large flush and by the first flow rate q1 of a small flush. Accordingly, flush water amounts can be accurately switched.

Hereinafter, operational effects produced by the first embodiment described above will be described.

In the flush toilet according to the first embodiment of the present invention, since the flush water is spouted at the first flow rate Q1/q1 from the jet spout port 14 when the discharge device 26 is driven and the flush water in the reservoir tank 4 flows into the jet water conduit 16 and, after spouting of the first flow rate Q1/q1 ends, the flush water is spouted at the second flow rate Q2/q2 from the jet spout port 14 due to the flush water retained in the jet water conduit 16 flowing toward the jet spout port 14, a siphon action can be generated by the first flow rate Q1/q1 and the siphon action can be continued by the second flow rate Q2/q2. Accordingly, even with the siphon jet flush toilet 1 in which the jet water conduit 16 is arranged lower than the top portion 8*d* of the discharge trap conduit 8, a sufficient siphon action for discharging waste can be generated and continued and, accordingly, waste discharge performance can be improved.

In addition, in the flush toilet according to the first embodiment of the present invention, since the maximum instantaneous flow rate Q2*max*/q2*max* of the second flow rate Q2/q2 is set smaller than the maximum instantaneous flow rate Q1*max*/q1*max* of the first flow rate Q1/q1, the siphon action can be continued by the second flow rate Q2/q2 of which the maximum instantaneous flow rate is small. Accordingly, both an improvement in waste discharge performance and water conservation can be achieved.

In the flush toilet according to the first embodiment of the present invention, since the instantaneous flow rate of the second flow rate Q2/q2 is set so as to reach the maximum instantaneous flow rate Q2*max*/q2*max* by increasing (increasing rate B/b) more gradually than the instantaneous flow rate of the first flow rate Q1/q1, the flush water spouted from the jet spout port 14 can be prevented from being disturbed as compared to rapidly increasing the instantaneous flow rate. Accordingly, the flush water can cause the siphon action to continue by smoothly flowing into the discharge trap conduit 8.

In addition, in the flush toilet according to the first embodiment of the present invention, since the flush water amount is set to be switched between a large flush and a small flush by adjusting the jet spouting time by the first flow rate Q1/q1, the flush water amount can be reliably switched.

In the flush toilet according to the first embodiment of the present invention, since the flush water is spouted at the second flow rate Q2/q2 from the jet spout port 14 after the discharge device 26 stops, the flush water can be spouted at the second flow rate Q2/q2 from the jet spout port 14 by the flush water retained in the jet water conduit 16.

In addition, in the flush toilet according to the first embodiment of the present invention, since the upstream flow channel 16*a* is arranged approximately parallel to the discharge trap conduit 8 and the bottom surface 16*d* on the downstream side of the upstream flow channel 16*a* is positioned lower than the upper end 8*e* of the inlet 8*a* of the discharge trap conduit 8, even when the seal water level drops and the siphon action almost ends, flush water is continuously retained on the downstream side of the upstream flow channel 16*a* and, therefore, the siphon action can be continued.

In the flush toilet according to the first embodiment of the present invention, since the bottom surface 16*d* of the upstream flow channel 16*a* is positioned lower than the upper end 8*e* of the inlet 8*a* of the discharge trap conduit 8 in a region more toward the front than the top portion 8*d* of the discharge trap conduit 8, even when the seal water level drops and the siphon action almost ends, flush water is continuously retained in the upstream flow channel 16*a* and, therefore, the siphon action can be continued.

In addition, in the flush toilet according to the first embodiment of the present invention, since the center O1 of the jet spout port 14 is arranged at the lowermost position of the center axis X of the jet water conduit 16, flush water can be spouted over a long period of time from the jet spout port 14.

In the flush toilet according to the first embodiment of the present invention, since the reservoir tank 4 is provided with the overflow pipe 30 configured to discharge overflowing water in the reservoir tank 4 and the overflow pipe 30 is provided at a same position as the discharge device 26 or more toward the rear than the discharge device 26, air displacement can be performed via the overflow pipe 30 on a rearward side of the jet water conduit 16 and a flow toward the jet spout port 14 can be prevented from being blocked by the air displacement.

In addition, in the flush toilet according to the first embodiment of the present invention, since the jet water conduit 16 has a capacity of ⅓ or more of the reservoir tank 4, a large amount of flush water can be retained in the jet water conduit 16. Accordingly, sufficient jet spouting for discharging waste can be performed even when the reservoir tank 4 is downsized.

In the flush toilet according to the first embodiment of the present invention, since the flush water is spouted from the rim spout port 10 after the discharge device 26 is stopped and the flush water from the rim spout port 10 is added to the flush water spouted from the jet spout port 14 even when the discharge device 26 is stopped, the siphon action can be further continued.

In addition, in the flush toilet according to the first embodiment of the present invention, since the curved portion 40 eccentrically positioned on an opposite side to the upstream flow channel with respect to the center axis of the jet spout port 14 is formed in the downstream flow channel 16*c* of the jet water conduit 16, a flow velocity distribution of flush water spouted from the jet spout port 14 can be made approximately uniform. Furthermore, since the curved portion 40 is arranged inside the seal water region, the jet water conduit 16 can be made compact. Accordingly, even when the jet water conduit 16 is made compact, sufficient jet spouting for discharging waste can be performed and waste discharge performance can be improved.

In the flush toilet according to the first embodiment of the present invention, since the bending flow channel 16*b* is arranged inside the seal water region, the jet water conduit 16 can be made compact. Furthermore, since the bending flow channel 16*b* is arranged inside the seal water region, the bending flow channel 16*b* can always be filled with water. Accordingly, retention of air inside the bending flow channel 16*b* can be suppressed and the flow velocity distribution of flush water spouted from the jet spout port 14 can be made approximately uniform.

In addition, in the flush toilet according to the first embodiment of the present invention, since the rectifying portion 42 linearly extending toward the jet spout port 14 is formed in the downstream flow channel 16*c* on a downstream side of the curved portion 40, the flush water after flowing through the curved portion 40 can be rectified and the flow velocity distribution of flush water spouted from the jet spout port 14 can be made approximately uniform.

In the flush toilet according to the first embodiment of the present invention, since the jet water conduit 16 is molded by cast molding in which a space between the upstream flow channel 16*a* and the rectifying portion 42 of the downstream 16*c* flow channel 16*c* produces a solid compact, the space between the upstream flow channel 16*a* and the rectifying portion 42 of the downstream flow channel 16*c* can be made thin and the jet water conduit 16 can be made compact.

In addition, in the flush toilet according to the first embodiment of the present invention, since the bottom surface 16*e* of the bending flow channel 16*b* is formed approximately horizontally, the upper surface 16*h* of the bending flow channel 16*b* is inclined downward from the upstream side toward the downstream side, and the height position of the upper surface 16*h* of the bending flow channel 16*b* is higher on a side of the outer circumference surface than on a side of the inner circumference surface, the side of the outer circumference surface can be made larger than the side of the inner circumference surface in a flow channel cross-sectional area of the bending flow channel 16*b* and an occurrence of flow separation on the side of the outer circumference surface where a relatively large amount of flush water flows can be suppressed. Accordingly, the flow velocity distribution of flush water spouted from the jet spout port 14 can be made approximately uniform.

In the flush toilet according to the first embodiment of the present invention, since the jet water conduit 16 and/or the buffer portion 50 is configured such that flush water spouted from the jet spout port 14 flows toward the center O2 of the inlet 8*a* of the discharge trap conduit 8, the flush water can be spouted from the jet spout port toward the center O2 of the inlet 8*a* of the discharge trap conduit 8 even when the jet water conduit 16 is made compact. Accordingly, the jet water conduit 16 can be made compact, sufficient jet spouting for discharging waste can be performed, and waste discharge performance can be improved.

In addition, in the flush toilet according to the first embodiment of the present invention, since the curvature radius r2 on the downstream side of the inner circumference surface of the bending flow channel 16*b* is smaller than the curvature radius r1 on an upstream side in a top view and the inner circumference surface on the downstream side of the bending flow channel 16*b* which is a portion where stagnation occurs is formed by the relatively small curvature radius r2, the bending flow channel 16*b* can be made compact while suppressing an occurrence of energy loss.

In the flush toilet according to the first embodiment of the present invention, since the curvature radius R2 on the downstream side of the outer circumference surface of the bending flow channel 16*b* is larger than the curvature radius R1 on the upstream side in a top view and the outer circumference surface on the downstream side of the bending flow channel 16*b* where a relatively large amount of flush water flows is formed by the relatively large curvature radius R2, the flush water can be allowed to flow while maintaining its flow velocity, and an occurrence of flow separation on the outer circumference surface of the bending flow channel 16*b* can be suppressed.

In addition, in the flush toilet according to the first embodiment of the present invention, since the bottom surface 16*e* of the bending flow channel 16*b* is formed approximately horizontally, the upper surface 16*h* of the bending flow channel 16*b* is inclined downward from the upstream side toward the downstream side, and the height position of the upper surface 16*h* of the bending flow channel 16*b* is higher on a side of the outer circumference surface than on a side of the inner circumference surface, the side of the outer circumference surface can be made larger than the side of the inner circumference surface in a flow channel cross-sectional area of the bending flow channel 16*b* and an occurrence of flow separation on the side of the outer circumference surface where a relatively large amount of flush water flows can be suppressed.

In the flush toilet according to the first embodiment of the present invention, since the bending flow channel 16*b* is arranged inside the seal water region, the jet water conduit 16 can be made compact. In addition, the bending flow channel 16*b* can be constantly filled with water and retention of air inside the bending flow channel 16*b* can be suppressed.

Next, a flush toilet 100 according to a second embodiment of the present invention will be described with reference to FIGS. 10 to 13.

With the exception of shapes of a downstream side of a jet water conduit and a buffer portion, a basic configuration is similar to that of the flush toilet 1 according to the first embodiment of the present invention described above.

Hereinafter, only differences from the flush toilet 1 according to the first embodiment will be described and descriptions of similar components, actions, and effects will be omitted.

Figure 10:
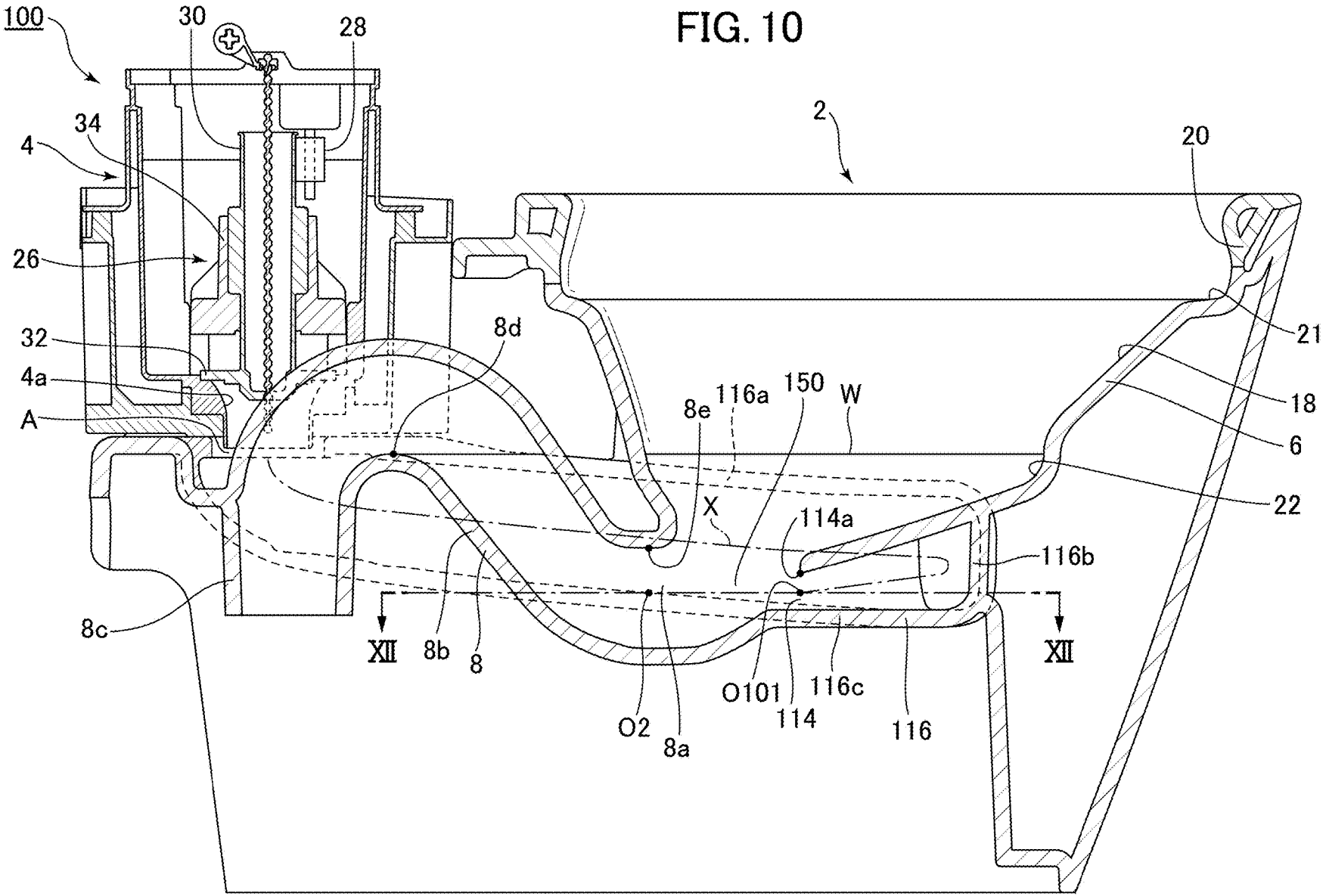
FIG. 10 is a side sectional view showing a flush toilet according to a second embodiment of the present invention.
Figure 11:
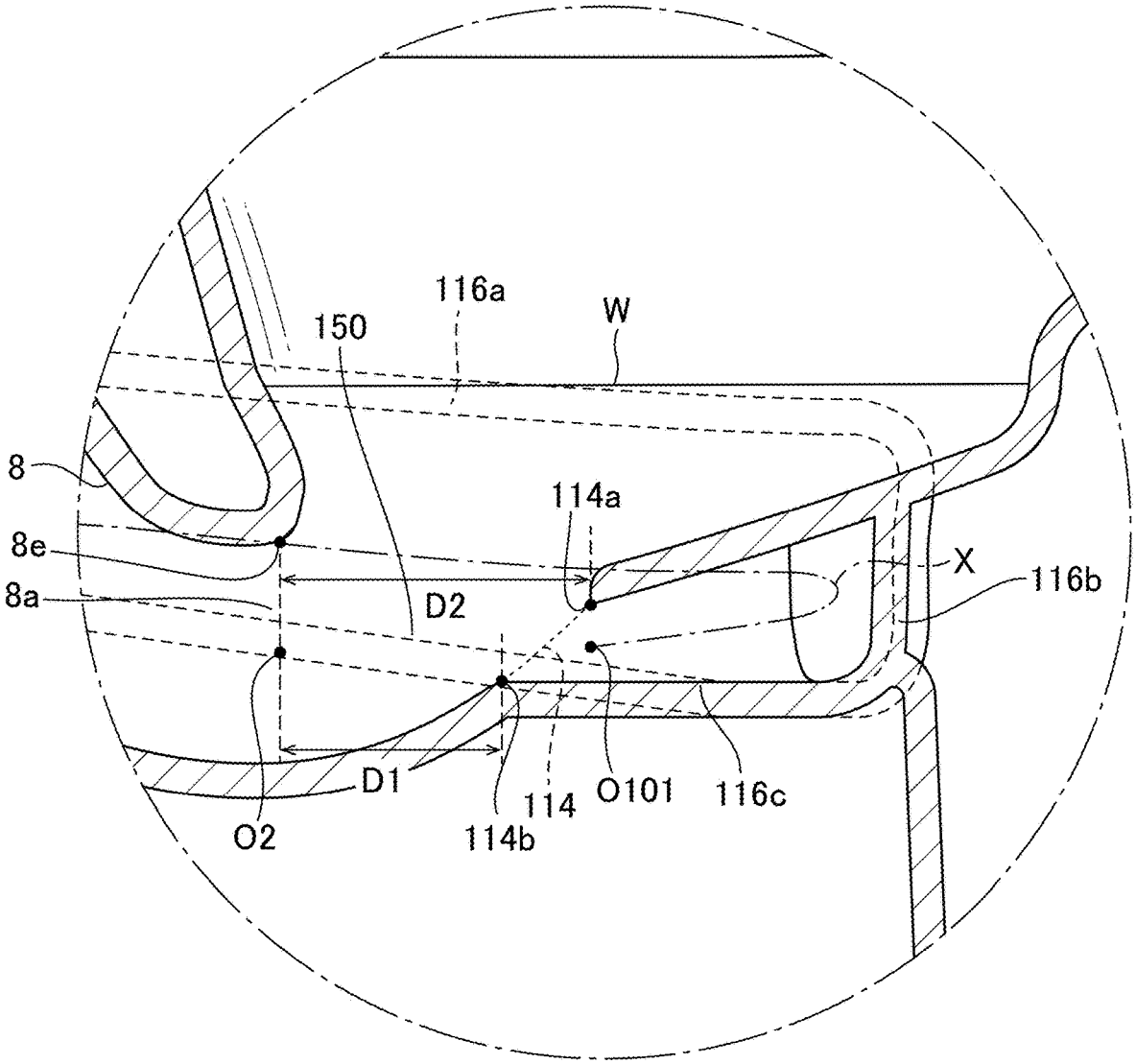
FIG. 11 is a partial enlarged view which enlarges a portion of a jet spout port of the flush toilet according to the second embodiment of the present invention shown in FIG. 10.
Figure 12:
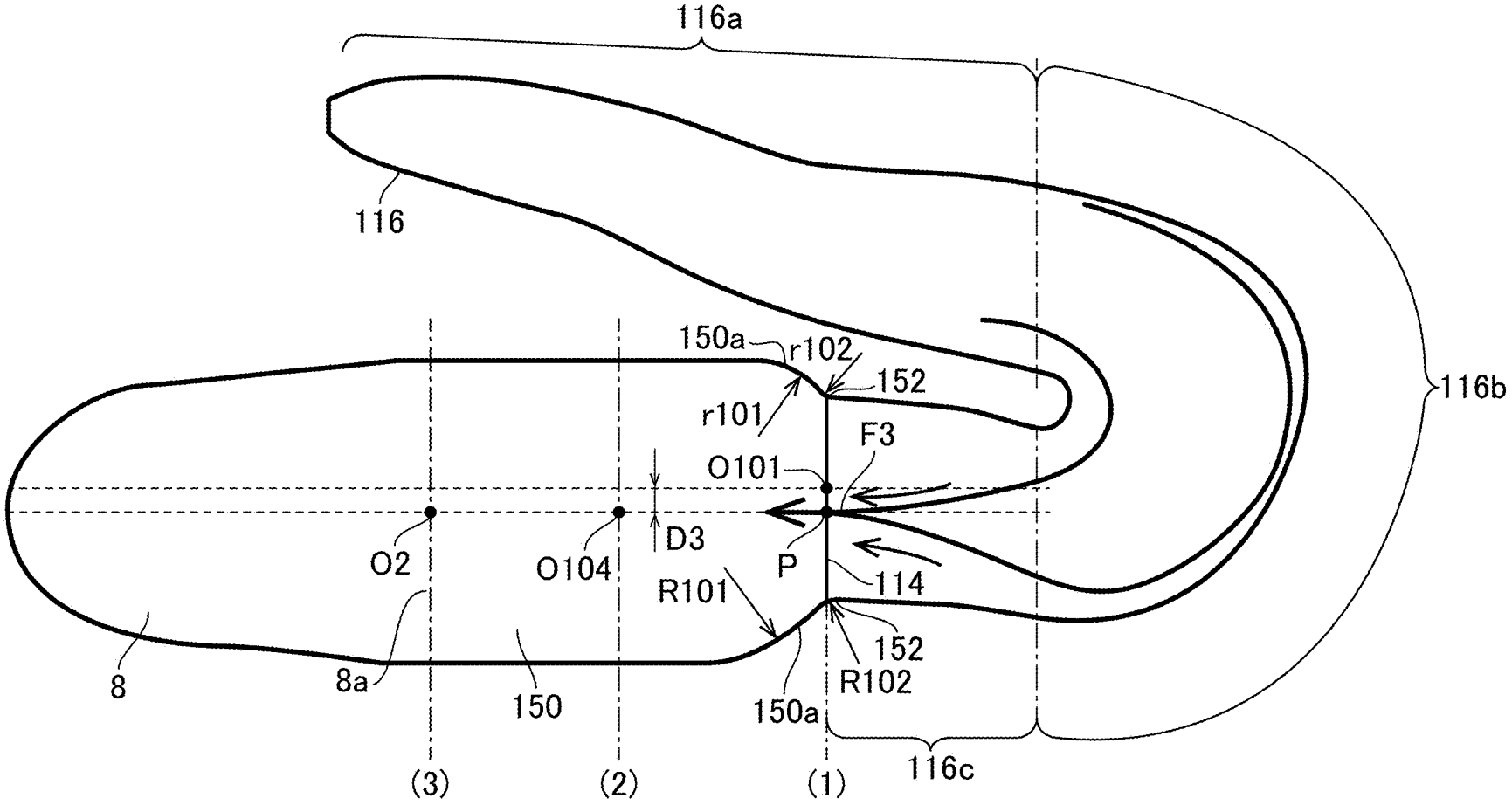
FIG. 12 is a plan sectional view taken along line XII-XII in FIG. 10.
Figure 13:
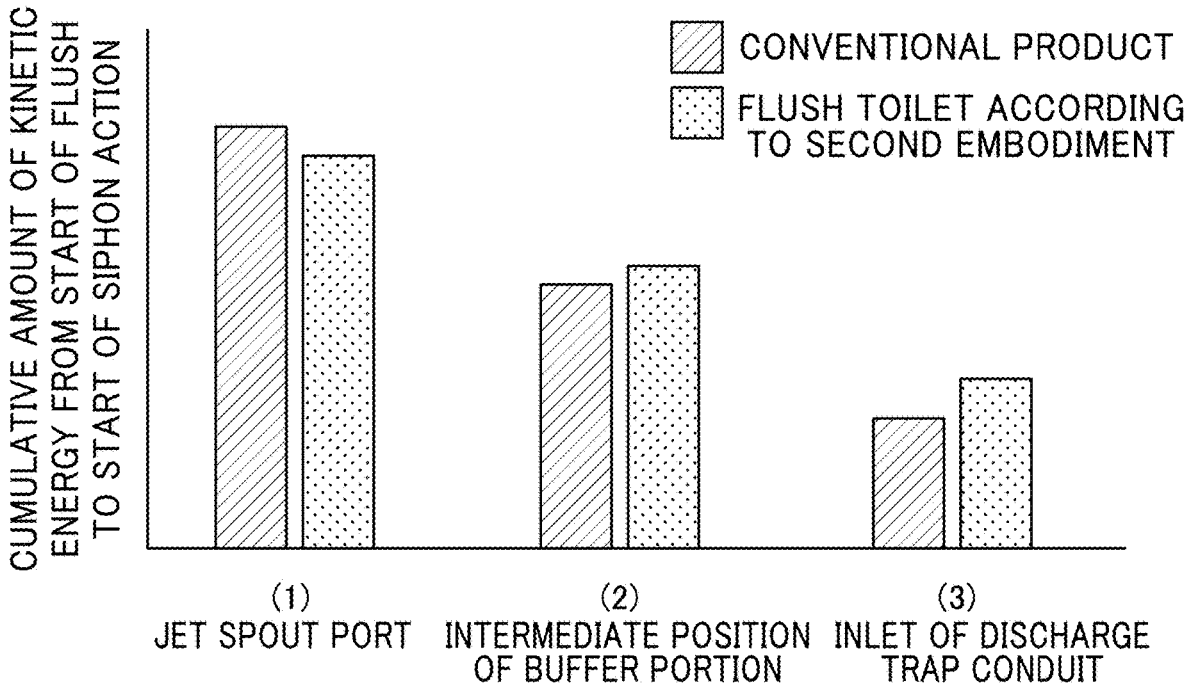
FIG. 13 is a view comparing a cumulative amount of kinetic energy from start of flush to start of a siphon action of the flush toilet according to the second embodiment of the present invention with a conventional product.

FIG. 10 is a side sectional view which shows the flush toilet according to the second embodiment of the present invention and which corresponds to FIG. 2 in the first embodiment. FIG. 11 is a partial enlarged view which enlarges a portion of a jet spout port of the flush toilet according to the second embodiment of the present invention shown in FIG. 10, FIG. 12 is a plan sectional view taken along line XII-XII in FIG. 10, and FIG. 13 is a view comparing a cumulative amount of kinetic energy from start of flush to start of a siphon action of the flush toilet according to the second embodiment of the present invention with a conventional product. Note that in the flush toilet 100 according to the second embodiment of the present invention shown in FIGS. 10 to 13, the same portions as the flush toilet 1 according to the first embodiment of the present invention described above are denoted by the same reference signs.

As shown in FIGS. 10 and 11, a lower end 114*b* of a jet spout port 114 is arranged closer than an upper end 114*a* to the inlet 8*a* of the discharge trap conduit 8. A distance D1 in a front-rear direction from the lower end 114*b* of the jet spout port 114 to the inlet 8*a* of the discharge trap conduit 8 is shorter than a distance D2 in the front-rear direction from the upper end 114*a* of the jet spout port 114 to the inlet 8*a* of the discharge trap conduit 8. In this manner, the jet spout port 114 is inclined downward toward the inlet 8*a* of the discharge trap conduit 8 on a side cross section. Accordingly, since a region where a buffer portion 150 is formed decreases, energy loss which is sustained when flush water passes through the buffer portion 150 is reduced and the flush water which is spouted from the jet spout port 114 is to swiftly flow into the discharge trap conduit 8.

As shown in FIG. 12, a jet water conduit 116 includes an upstream flow channel 116*a* which extends forward from the reservoir tank 4, a bending flow channel 116*b* which bends from the upstream flow channel 116*a*, and a downstream flow channel 116*c* which extends rearward from the bending flow channel 116*b* and which connects to the jet spout port 114. The buffer portion 150 is provided between the jet spout port 114 and the inlet 8*a* of the discharge trap conduit 8 and the jet water conduit 116 is communicated with the discharge trap conduit 8 via the buffer portion 150.

As shown in FIG. 12, a center O101 of the jet spout port 114 is eccentrically arranged toward a side of the upstream flow channel 116*a* by an eccentric distance D3 with respect to a center O104 of a flow channel cross section of the buffer portion 150 and the center O2 of the inlet 8*a* of the discharge trap conduit 8. The jet water conduit 116 is set such that a position P of a main flow F3 of flush water which passes through the jet spout port 114 is approximately coaxial with respect to the center O104 of the flow channel cross section of the buffer portion 150 and the center O2 of the inlet 8*a* of the discharge trap conduit 8 in a top view. Accordingly, flush water is spouted from the jet spout port 114 toward the center O2 of the inlet 8*a* of the discharge trap conduit 8.

Next, an upstream end portion 150*a* which is positioned at an upstream end of the buffer portion 150 is formed of a curvature radius r101 on a side of an inner circumference surface and a curvature radius R101 on a side of an outer circumference surface in a top view and the curvature radius r101 on the side of the inner circumference surface is made smaller than the curvature radius R101 on the side of the outer circumference surface. Accordingly, since the flush water which is spouted from the jet spout port 114 flows by being drawn to the side of the inner circumference surface with the relatively small curvature radius r101, the flush water which is spouted from the jet spout port 114 is to flow toward the center O2 of the inlet 8*a* of the discharge trap conduit 8.

In addition, as shown in FIG. 12, the jet water conduit 116 and the buffer portion 150 are connected to each other via a connecting portion 152. The connecting portion 152 is formed of a curvature radius r102 on a side of an inner circumference surface and a curvature radius R102 on a side of an outer circumference surface in a top view and the curvature radius r102 on the side of the inner circumference surface and the curvature radius R102 on the side of the outer circumference surface are made so as to have approximately the same magnitude. In addition, the curvature radius r102 on the side of the inner circumference surface and the curvature radius R102 on the side of the outer circumference surface of the connecting portion 152 are formed so as to be smaller than the curvature radius r101 on the side of the inner circumference surface of the upstream end portion 150*a* of the buffer portion 150 in a top view. Accordingly, an occurrence of flow separation can be suppressed when flush water is spouted from the jet spout port 114.

Next, kinetic energy when flush water which is spouted from the jet spout port 114 of the flush toilet 100 according to the second embodiment of the present invention flows into the discharge trap conduit 8 will be described with reference to FIG. 13.

FIG. 13 is a view comparing a cumulative amount of kinetic energy from start of flush to start of a siphon action of the flush toilet 100 according to the second embodiment of the present invention with a conventional product. The bars of kinetic energy of flush water shown in FIG. 13 having been measured using fluid analysis each represent cumulative amounts of kinetic energy at (1) a position of the jet spout port 114, (2) an intermediate position in the front-rear direction of the buffer portion 150, and (3) a position of the inlet 8*a* of the discharge trap conduit 8 shown in FIG. 12.

As shown in FIG. 13, with respect to kinetic energy of the respective parts in the conventional product, the kinetic energy is largest at the position of the jet spout port 114, the kinetic energy is smaller at the intermediate position of the buffer portion 150 than the position of the jet spout port 114, and the kinetic energy is smaller at the inlet 8*a* of the discharge trap conduit 8 than the position of the jet spout port 114 and the intermediate position of the buffer portion 150.

As shown in FIG. 13, with respect to kinetic energy of the respective parts in the flush toilet 100 according to the second embodiment of the present invention, while the kinetic energy is smaller than the conventional product at the position of the jet spout port 114, the kinetic energy is larger than the conventional product at the intermediate position of the buffer portion 150 and the inlet 8*a* of the discharge trap conduit 8. In this manner, it is shown that in the flush toilet 100 according to the second embodiment of the present invention, sustainment of energy loss by flush water which is spouted from the jet spout port 114 is suppressed and the flush water flows into the discharge trap conduit 8.

Hereinafter, operational effects produced by the second embodiment described above will be described.

First, in the flush toilet according to the second embodiment of the present invention, since the jet water conduit 116 and/or the buffer portion 150 is configured such that the flush water spouted from the jet spout port 114 flows toward the center O2 of the inlet 8*a* of the discharge trap conduit 8, the flush water can be spouted from the jet spout port toward the center O2 of the inlet 8*a* of the discharge trap conduit 8 even when the jet water conduit 116 is made compact. Accordingly, the jet water conduit 116 can be made compact, sufficient jet spouting for discharging waste can be performed, and waste discharge performance can be improved.

In addition, in the flush toilet according to the second embodiment of the present invention, since the jet water conduit 116 is configured such that a position P of a main flow F3 of flush water which passes through the jet spout port 114 is approximately coaxial with respect to the center O104 of the flow channel cross section of the buffer portion 150 and the center O2 of the discharge trap conduit 8 in a top view, the flush water can be spouted from the jet spout port 114 toward the center O2 of the inlet 8*a* of the discharge trap conduit 8.

In the flush toilet according to the second embodiment of the present invention, since the curvature radius r101 on the side of the inner circumference surface is smaller than the curvature radius R101 on the side of the outer circumference surface of the upstream end portion 150*a* of the buffer portion 150 in a top view and the flush water which is spouted from the jet spout port 114 flows by being drawn to the side of the inner circumference surface with the relatively small curvature radius r101, the flush water spouted from the jet spout port 114 can be caused to flow toward the center O2 of the inlet 8*a* of the discharge trap conduit 8.

In addition, in the flush toilet according to the second embodiment of the present invention, since the curvature radius r102/R102 of the connecting portion 152 connecting the jet water conduit 116 and the buffer portion 150 to each other is smaller than the curvature radius r101 on the side of the inner circumference surface of the upstream end portion 150*a* of the buffer portion 150, an occurrence of flow separation when the flush water is spouted from the jet spout port 114 can be suppressed.

In the flush toilet according to the second embodiment of the present invention, since the distance D1 from the lower end 114*b* of the jet spout port 114 to the inlet 8*a* of the discharge trap conduit 8 is set shorter than the distance D2 from the upper end 114*a* of the jet spout port 114 to the inlet 8*a* of the discharge trap conduit 8, a region where the buffer portion 150 is formed can be reduced and energy loss which is sustained when the flush water is spouted from the jet spout port 114 can be reduced.

Next, a jet water conduit 216 of a flush toilet 200 according to a third embodiment of the present invention will be described in detail with reference to FIGS. 14 to 16B.

Figure 14:
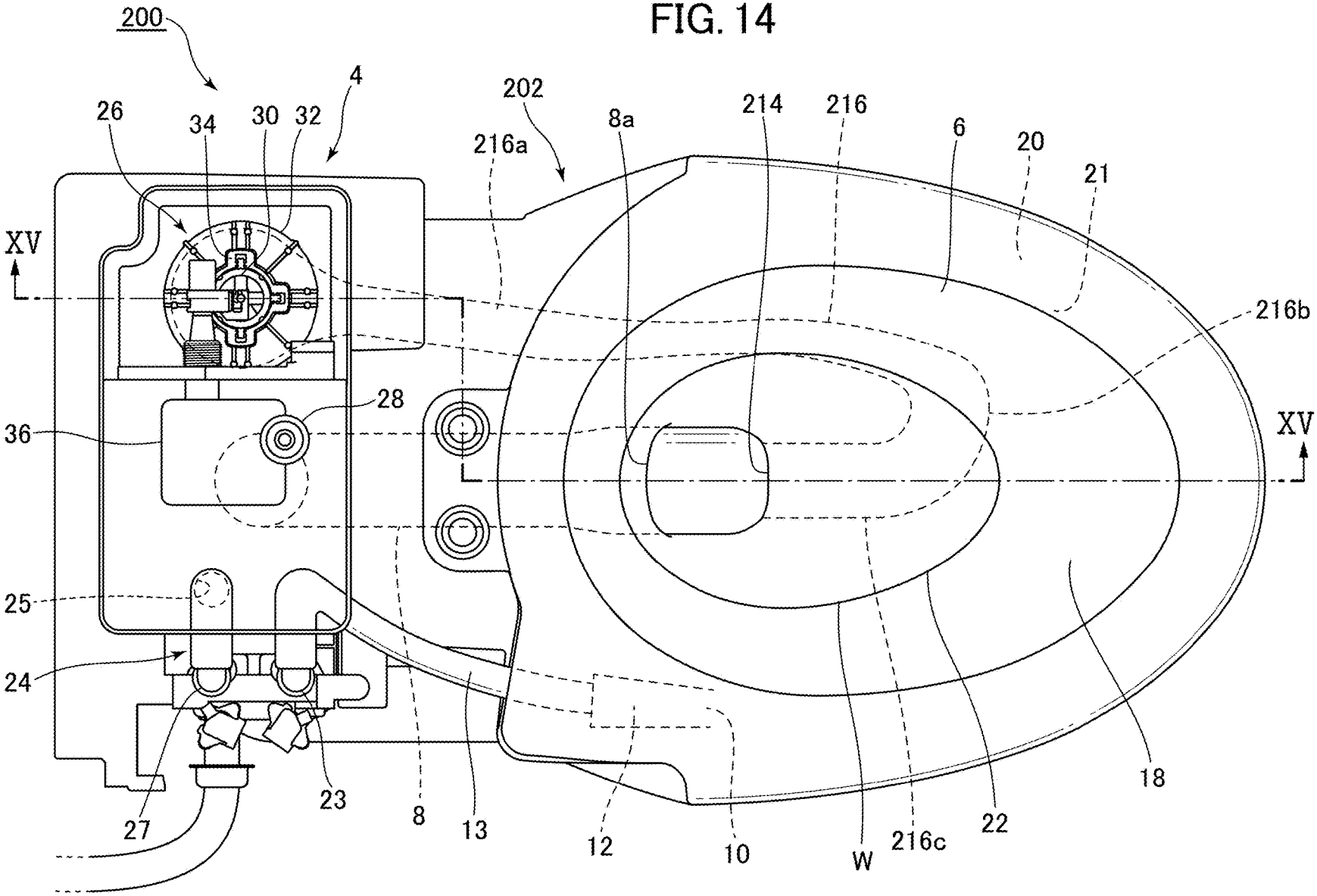
FIG. 14 is a plan view showing a flush toilet according to a third embodiment of the present invention.
Figure 15:
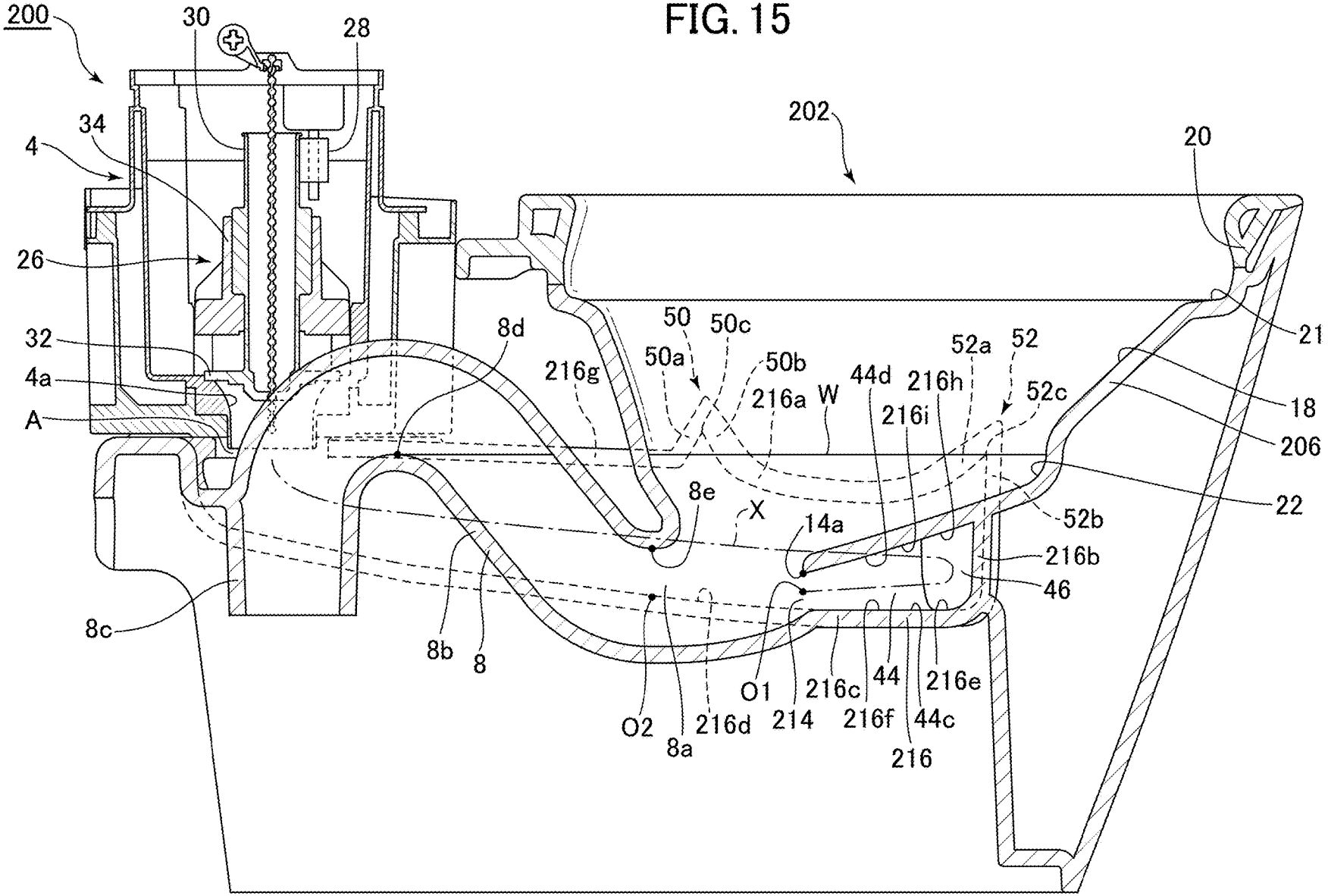
FIG. 15 is a side sectional view taken along line XV-XV in FIG. 14.
Figure 16A:
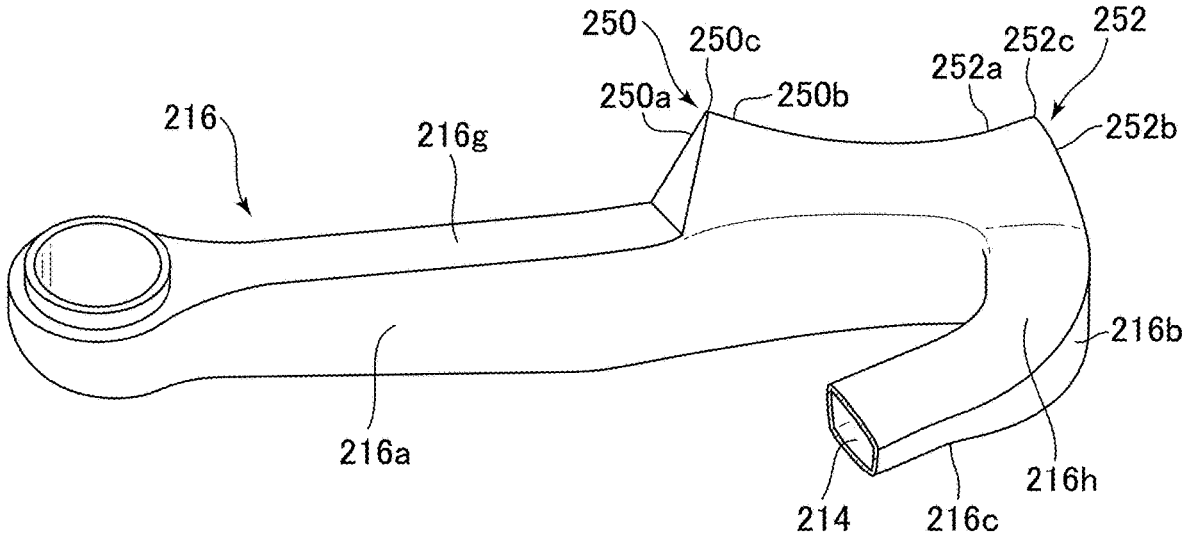
FIG. 16A is a perspective view showing a jet water conduit of the flush toilet according to the third embodiment of the present invention.
Figure 16B:
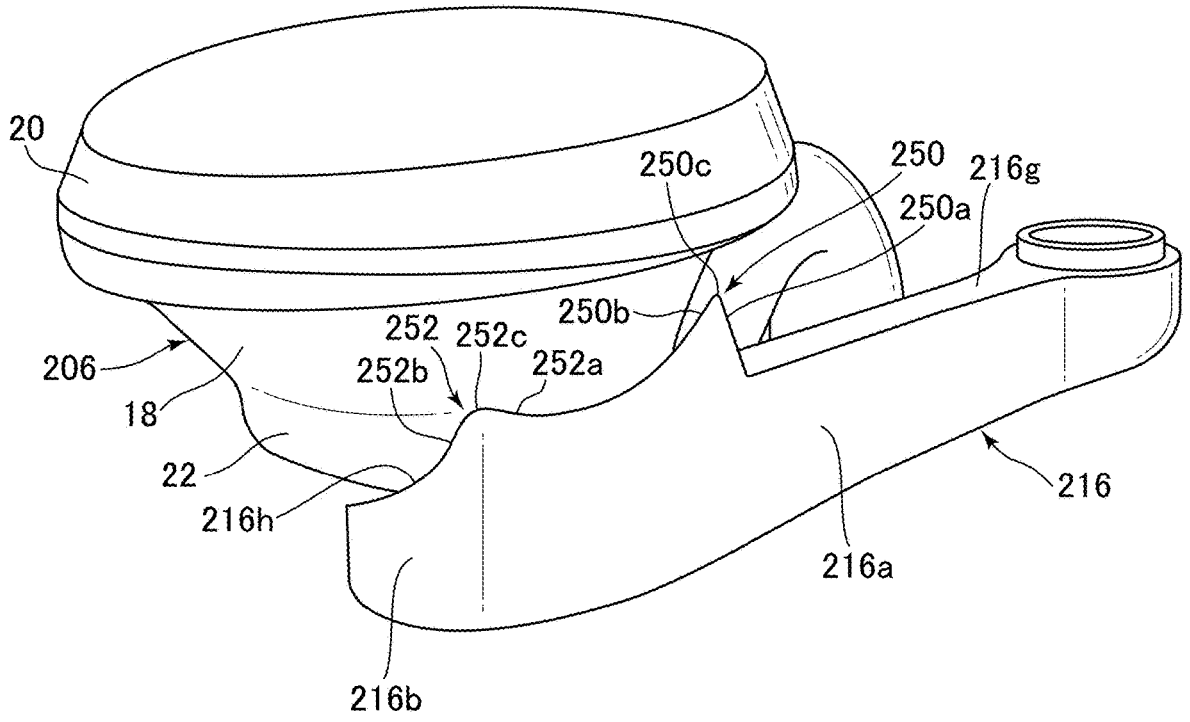
FIG. 16B is a perspective view for explaining a positional relationship between the jet water conduit and a bowl of the flush toilet according to the third embodiment of the present invention.

FIG. 14 is a plan view showing the flush toilet according to the third embodiment of the present invention, FIG. 15 is a side sectional view taken along line XV-XV in FIG. 14, FIG. 16A is a perspective view showing the jet water conduit of the flush toilet according to the third embodiment of the present invention, and FIG. 16B is a perspective view for explaining a positional relationship between the jet water conduit and a bowl of the flush toilet according to the third embodiment of the present invention. Note that in the flush toilet 200 according to the third embodiment of the present invention shown in FIGS. 14 to 16B, the same portions as the flush toilet 1 according to the first embodiment of the present invention described above are denoted by the same reference signs.

First, as shown in FIG. 14, the jet water conduit 216 is formed in a U-shape as a whole and connects the discharge port 4*a* of the reservoir tank 4 arranged on a right side and a jet spout port 214 arranged at center in a left-right direction when a toilet main body 202 is viewed from the front to each other. An upstream flow channel 216*a* of the jet water conduit 216 extends toward the front from the discharge port 4*a* of the reservoir tank 4 while being approximately parallel to the discharge trap conduit 8. In addition, a bending flow channel 216*b* of the jet water conduit 216 bends (makes a U-turn) toward the rear from a downstream end of the upstream flow channel 216*a*. Furthermore, a downstream flow channel 216*c* of the jet water conduit 216 extends to the rear from a downstream end of the bending flow channel 216*b* toward the inlet 8*a* of the discharge trap conduit 8.

Next, as shown in FIG. 15, with the exception of a partial region A (a region in a vicinity of the discharge port 4*a* of the reservoir tank 4) of the upstream flow channel 216*a* positioned directly below the reservoir tank 4, the jet water conduit 216 is arranged lower than the top portion 8*d* of the discharge trap conduit 8 or, in other words, lower than the seal water surface W. In addition, as shown in FIG. 16A, a vertical width and a horizontal width of the flow channel cross section of the jet water conduit 216 are made larger than conventional products and, accordingly, a capacity of the jet water conduit as a whole is increased. Specifically, the jet water conduit 216 has a capacity (approximately 1 liter) that is ⅓ or more of a capacity (approximately 3 liters) of the reservoir tank 4. Furthermore, the jet water conduit 216 has a capacity (approximately 1 liter) that is half or more of an amount (approximately 2 liters) of flush water that is discharged from the reservoir tank 4 in one flush. Accordingly, as compared to conventional products, a larger amount of flush water can be retained in the jet water conduit 216 and jet spouting can be performed by head pressure of the retained flush water.

As shown in FIG. 15, a bottom surface 216*d* of the upstream flow channel 216*a* of the jet water conduit 216 is formed inclined downward from the upstream side toward the downstream side and a bottom surface 216*e* of the bending flow channel 216*b* and a bottom surface 216*f* of the downstream flow channel 216*c* are formed approximately horizontal at approximately same height positions. As shown in FIG. 15, an upper surface 216*g* of the upstream flow channel 216*a* of the jet water conduit 216 is formed approximately horizontal at approximately a same height position as the seal water surface W. An upper surface 216*h* of the bending flow channel 216*b* and an upper surface 216*i* of the downstream flow channel 216*c* are formed inclined downward from the upstream side toward the downstream side.

Next, as shown in FIG. 14, the bending flow channel 216*b* is compactly formed by being bent along an outer edge of the seal water surface W in a top view. In addition, since the bending flow channel 216*b* is arranged in a vicinity of the seal water surface W, the bending flow channel 216*b* can be constantly approximately filled with water and air can be prevented from being retained inside the bending flow channel 216*b*.

Next, as shown in FIGS. 14 and 16A, the upstream flow channel 216*a* of the jet water conduit 216 is provided with a first air retaining portion 250 which extends higher than the upper surface 216*g* of the upstream flow channel 216*a*. Accordingly, when flush water flows through the jet water conduit 216, air retained in the jet water conduit 216 or/and air flowing into the jet water conduit 216 from the overflow pipe 30 is pushed into the first air retaining portion 250.

The first air retaining portion 250 is equipped with a wall surface 250*a* on an upstream side, a wall surface 250*b* on a downstream side, and an upper end 250*c* between the upstream-side wall surface 250*a* and the downstream-side wall surface 250*b* and is formed in a tapered shape toward the upper end 250*c*. Accordingly, air having flowed into the first air retaining portion 250 can be collected in an upper part. In addition, a slope angle with respect to a vertical line passing through the upper end 250*c* of the upstream-side wall surface 250*a* is made smaller than a slope angle of the downstream-side wall surface 250*b* (the upstream-side wall surface 250*a* is in a near-vertical state). Accordingly, a situation can be prevented where a flow toward the jet spout port 214 is impeded due to flush water which flows in the upstream flow channel 216*a* in a lateral direction excessively flowing into the first air retaining portion 250.

Next, as shown in FIGS. 14 and 16B, the first air retaining portion 250 is formed along the bowl 6. Accordingly, a dead space behind the bowl 6 can be effectively utilized and the toilet as a whole can be made compact. The upper end 250*c* of the first air retaining portion 250 is positioned higher than the seal water surface W. Accordingly, air can be reliably retained in the first air retaining portion 250.

As shown in FIGS. 14 and 16A, the bending flow channel 216*b* of the jet water conduit 216 is provided with a second air retaining portion 252 which extends higher than the upper surface 216*h* of the bending flow channel 216*b*. Accordingly, when flush water flows through the jet water conduit 216, air which has not been pushed into the first air retaining portion 250 or/and air having flowed out from the first air retaining portion 250 is pushed into the second air retaining portion 252.

The second air retaining portion 252 is equipped with a wall surface 252*a* on an upstream side, a wall surface 252*b* on a downstream side, and an upper end 252*c* between the upstream-side wall surface 252*a* and the downstream-side wall surface 252*b* and is formed in a tapered shape toward the upper end 252*c*. Accordingly, air having flowed into the second air retaining portion 252 can be collected in an upper part. In addition, a slope angle with respect to a vertical line passing through the upper end 252*c* of the upstream-side wall surface 252*a* is made larger than a slope angle of the downstream-side wall surface 252*b* (the upstream-side wall surface 252*a* is in a near-horizontal state). Accordingly, air which has not been pushed into the first air retaining portion 250 or/and air having flowed out from the first air retaining portion 250 is readily pushed into the second air retaining portion 252.

Next, as shown in FIGS. 14 and 16B, the second air retaining portion 252 is formed along the bowl 6. Accordingly, a dead space behind the bowl 6 can be effectively utilized and the toilet as a whole can be made compact. The upper end 252*c* of the second air retaining portion 252 is positioned at approximately the same position as the seal water surface W. Accordingly, air can be reliably retained in the second air retaining portion 252.

Next, a downstream portion of the jet water conduit 216 of the flush toilet 200 according to the third embodiment of the present invention will be described in detail with reference to FIGS. 14, 17, and 18A to 18G.

Figure 17:
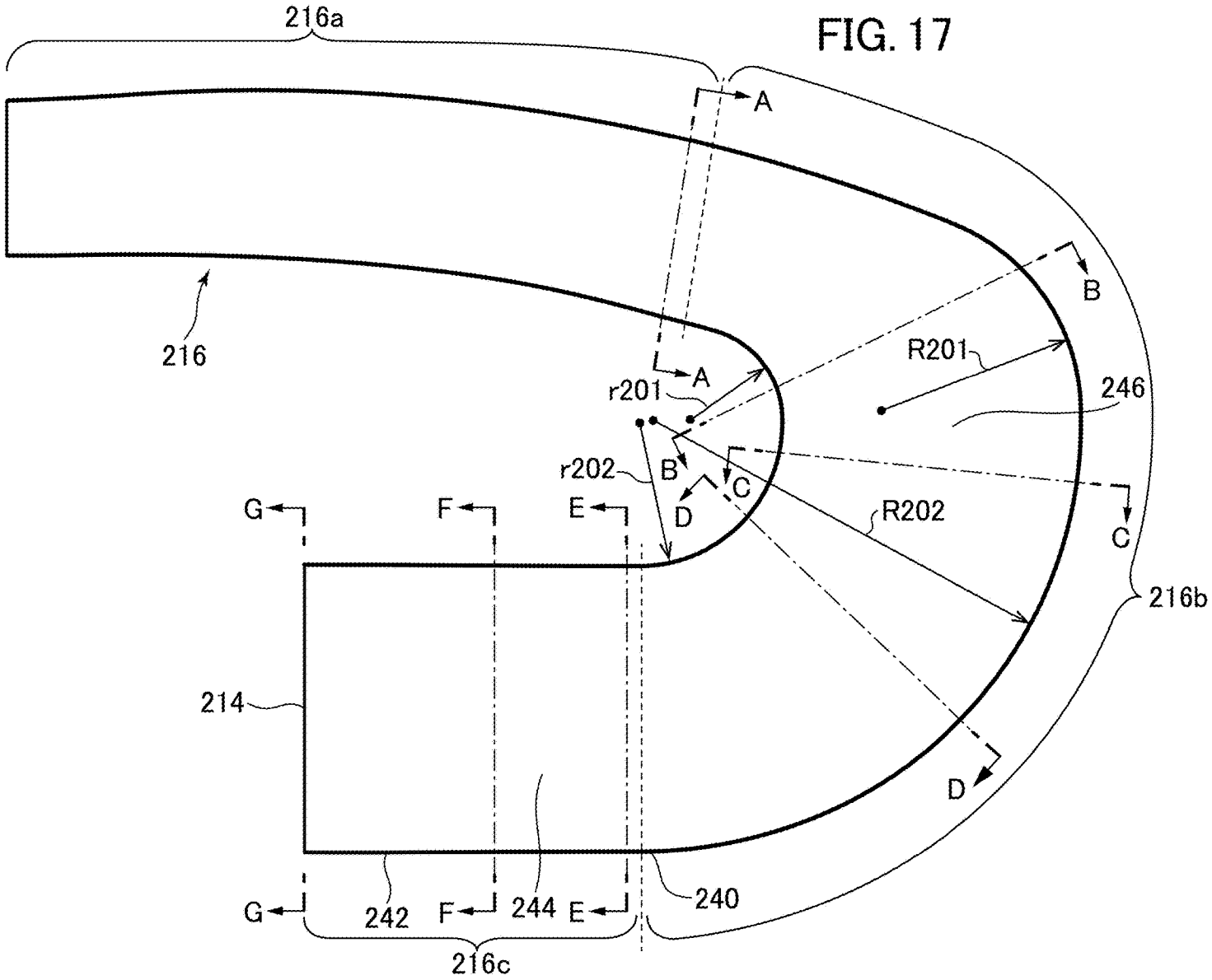
FIG. 17 is a plan sectional view of a downstream portion of the jet water conduit of the flush toilet according to the third embodiment of the present invention shown in FIG. 14.

FIG. 17 is a plan sectional view of the downstream portion of the jet water conduit of the flush toilet according to the third embodiment of the present invention shown in FIG. 14, and FIGS. 18A to 18G are views showing flow channel cross sections A to G of the jet water conduit of the flush toilet according to the third embodiment of the present invention shown in FIG. 17.

First, as shown in FIGS. 17 and 18E to 18G, a narrowed portion 244 which has a smallest flow channel cross-sectional area in the jet water conduit 216 is formed in the downstream flow channel 216*c* of the jet water conduit 216. The flow channel cross-sectional area of the narrowed portion 244 gradually contracts toward the jet spout port 214 (refer to FIGS. 18E to 18G). Accordingly, flush water passing through the narrowed portion 244 gradually increases its flow velocity and the flush water can be spouted from the jet spout port 214.

Figure 18A:
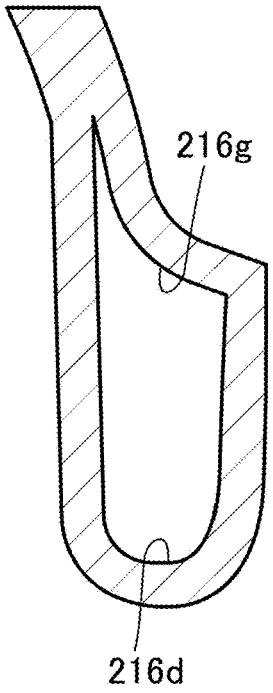
FIG. 18A is a view showing a flow channel cross section A of the jet water conduit of the flush toilet according to the third embodiment of the present invention shown in FIG. 17.
Figure 18B:
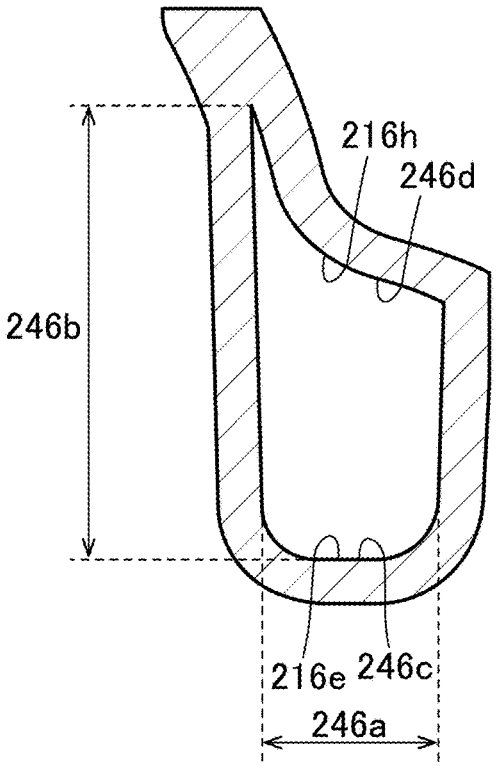
FIG. 18B is a view showing a flow channel cross section B of the jet water conduit of the flush toilet according to the third embodiment of the present invention shown in FIG. 17.
Figure 18C:
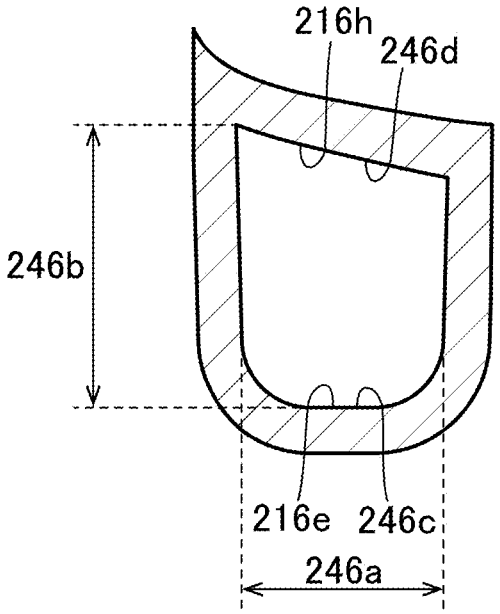
FIG. 18C is a view showing a flow channel cross section C of the jet water conduit of the flush toilet according to the third embodiment of the present invention shown in FIG. 17.
Figure 18D:
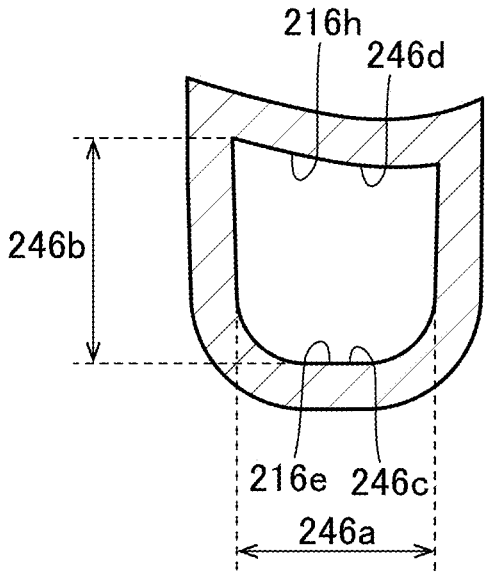
FIG. 18D is a view showing a flow channel cross section D of the jet water conduit of the flush toilet according to the third embodiment of the present invention shown in FIG. 17.
Figure 18E:
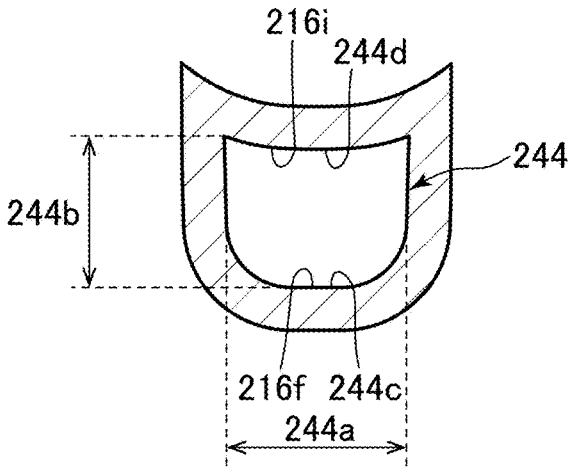
FIG. 18E is a view showing a flow channel cross section E of the jet water conduit of the flush toilet according to the third embodiment of the present invention shown in FIG. 17.
Figure 18F:
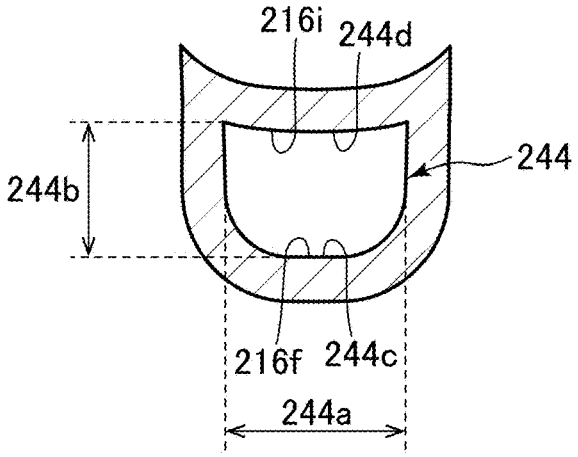
FIG. 18F is a view showing a flow channel cross section F of the jet water conduit of the flush toilet according to the third embodiment of the present invention shown in FIG. 17.
Figure 18G:
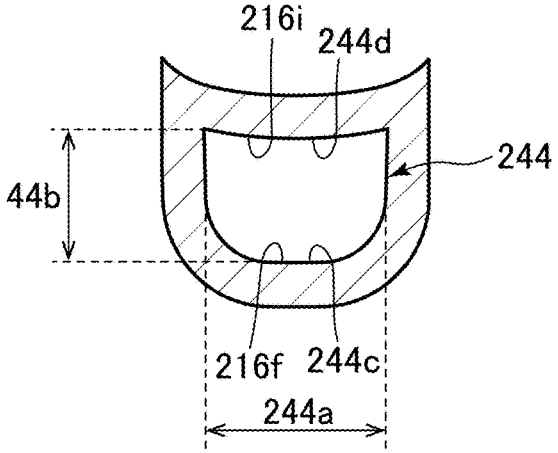
FIG. 18G is a view showing a flow channel cross section G of the jet water conduit of the flush toilet according to the third embodiment of the present invention shown in FIG. 17.

As shown in FIGS. 18E to 18G, a horizontal width 244*a* of the narrowed portion 244 is approximately constant while a vertical width 244*b* of the narrowed portion 244 gradually decreases toward the jet spout port 214. In addition, a bottom surface 244*c* of the narrowed portion 244 is formed approximately horizontally and an upper surface 244*d* of the narrowed portion 244 is inclined downward toward the jet spout port 214. Accordingly, flush water can be guided downward by the upper surface 244*d* while suppressing pressure loss.

Furthermore, the narrowed portion 244 extends linearly toward the jet spout port 214. Accordingly, a situation where flush water passing through the narrowed portion 244 is subjected to pressure loss due to bending of the flow channel can be suppressed and the flush water can be rectified.

Next, as shown in FIGS. 17 and 18B to 18D, a constant cross-sectional area portion 246 of which a flow channel cross-sectional area is constant is formed in the bending flow channel 216*b* on the upstream side of the narrowed portion 244. Accordingly, pressure loss due to contraction of the flow channel can be suppressed.

As shown in FIGS. 18B to 18D, a horizontal width 246*a* of the constant cross-sectional area portion 246 gradually increases toward the jet spout port 214 while a vertical width 246*b* of the constant cross-sectional area portion 246 gradually decreases toward the jet spout port 214. Accordingly, flush water can be guided downward while suppressing pressure loss due to contraction of the flow channel.

In addition, a bottom surface 246*c* of the constant cross-sectional area portion 246 is formed approximately horizontally and an upper surface 246*d* of the constant cross-sectional area portion 246 is inclined downward toward the jet spout port 214. Accordingly, flush water can be guided downward by the upper surface 246*d* of the constant cross-sectional area portion 246 while suppressing pressure loss.

The constant cross-sectional area portion 246 is formed from a bending start position (upstream end) of the bending flow channel 216*b* to a bending end position (downstream end) of the bending flow channel 216*b*. Accordingly, pressure loss due to bending of the flow channel and pressure loss due to contraction of the flow channel can be prevented from concurrently occurring in the bending flow channel 216*b*.

While the constant cross-sectional area portion 246 is formed from the upstream end to the downstream end of the bending flow channel 216*b* in the present embodiment, the constant cross-sectional area portion 246 is not limited thereto and may be formed in a part of the bending flow channel 216*b*.

Next, as shown in FIG. 17, an outer circumference surface of the bending flow channel 216*b* is formed of a curvature radius R201 on the upstream side and a curvature radius R202 on the downstream side in a top view and the upstream-side curvature radius R201 is made smaller than the downstream-side curvature radius R202. Accordingly, pressure loss due to bending of the flow channel is generated on the upstream side of the bending flow channel 216*b* while pressure loss due to bending of the flow channel is prevented from being generated on a side of the narrowed portion 244 (the downstream side of the bending flow channel 216*b*) where pressure loss due to contraction of the flow channel occurs.

In addition, an inner circumference surface of the bending flow channel 216*b* is formed of a curvature radius r201 on the upstream side and a curvature radius r202 on the downstream side in a top view and the upstream-side curvature radius r201 is made smaller than the downstream-side curvature radius r202. Accordingly, pressure loss due to bending of the flow channel is generated on the upstream side of the bending flow channel 216*b* while pressure loss due to bending of the flow channel is prevented from being generated on a side of the narrowed portion 244 (the downstream side of the bending flow channel 216*b*) where pressure loss due to contraction of the flow channel occurs.

Hereinafter, operational effects produced by the third embodiment described above will be described.

In the flush toilet according to the third embodiment of the present invention, since the narrowed portion 244 with a smallest flow channel cross-sectional area in the jet water conduit 216 is formed in the downstream flow channel 216*c* of the jet water conduit 216 and the constant cross-sectional area portion 246 of which a flow channel cross-sectional area is constant is formed in the jet water conduit 216 on the upstream side of the narrowed portion 244, flush water can be guided to the downstream side by the constant cross-sectional area portion 246 while suppressing pressure loss due to contraction of the flow channel and, subsequently, the flush water can be spouted from the jet spout port 214 by increasing flow velocity of the flush water with the narrowed portion 244. Accordingly, sufficient jet spouting for discharging waste can be performed and waste discharge performance can be improved.

In addition, in the flush toilet according to the third embodiment of the present invention, since the flow channel cross-sectional area of the narrowed portion 244 gradually contracts toward the jet spout port 214, the flush water which passes through the narrowed portion 244 can gradually increase its flow velocity toward the jet spout port 214.

In the flush toilet according to the third embodiment of the present invention, since the constant cross-sectional area portion 246 is formed in the bending flow channel 216*b*, pressure loss due to bending of the flow channel and pressure loss due to contraction of the flow channel can be prevented from concurrently occurring in the bending flow channel 216*b*.

In addition, in the flush toilet according to the third embodiment of the present invention, since the vertical width 246*b* of the constant cross-sectional area portion 246 decreases while the horizontal width 246*a* of the constant cross-sectional area portion 246 increases toward the jet spout port 214, the constant cross-sectional area portion 246 can guide the flush water downward while suppressing pressure loss due to contraction of the flow channel.

In the flush toilet according to the third embodiment of the present invention, since the upper surface 246*d* of the constant cross-sectional area portion 246 inclines downward toward the jet spout port 214 and the bottom surface 246*c* of the constant cross-sectional area portion 246 is approximately horizontal, the constant cross-sectional area portion 246 can guide the flush water downward by the upper surface 246*d* while suppressing pressure loss.

In addition, in the flush toilet according to the third embodiment of the present invention, since the curvature radius R1 on the upstream side of the outer circumference surface of the bending flow channel 216*b* is smaller than the curvature radius R2 on the downstream side in a top view, pressure loss due to bending of the flow channel can be generated on the upstream side of the bending flow channel 216*b* while pressure loss due to bending of the flow channel can be prevented from being generated on a side of the narrowed portion 244 (the downstream side of the bending flow channel 216*b*) where pressure loss due to contraction of the flow channel occurs.

Next, a flush toilet according to a fourth embodiment of the present invention will be described.

Figure 19A:
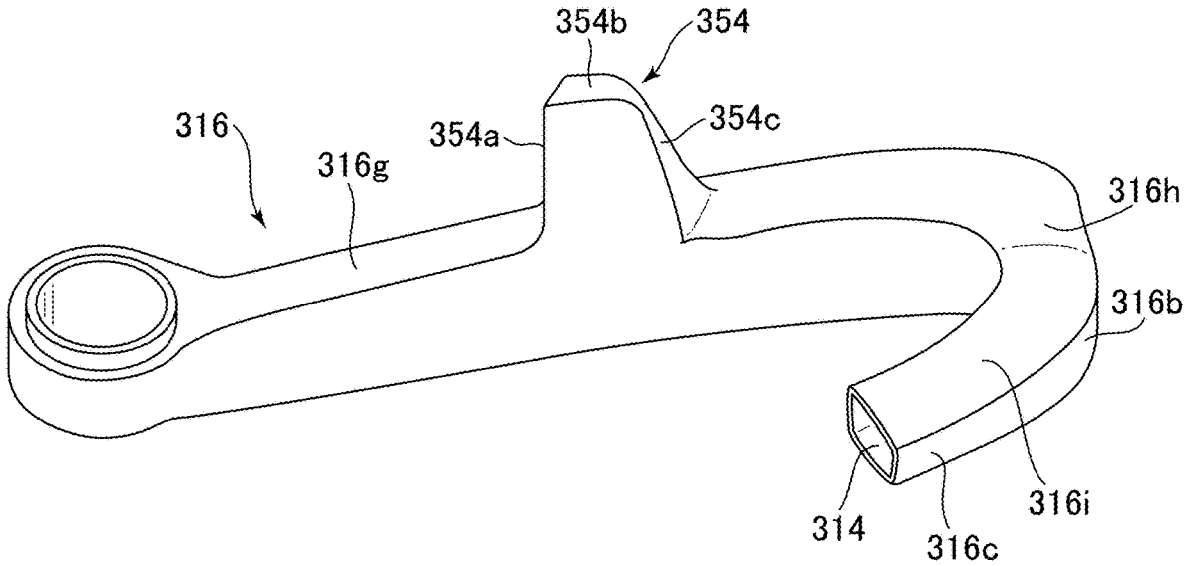
FIG. 19A is a perspective view showing a jet water conduit of a flush toilet according to a fourth embodiment of the present invention.
Figure 19B:
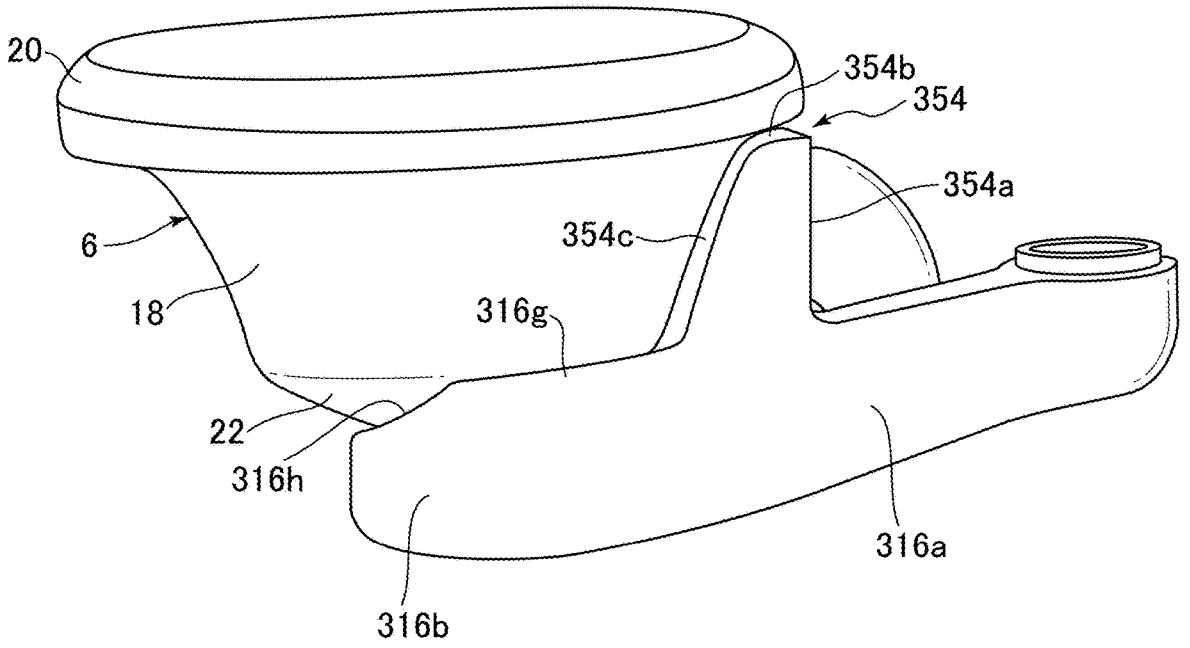
FIG. 19B is a perspective view for explaining a positional relationship between the jet water conduit and a bowl of the flush toilet according to the fourth embodiment of the present invention.

FIG. 19A is a perspective view showing a jet water conduit of the flush toilet according to the fourth embodiment of the present invention, and FIG. 19B is a perspective view for explaining a positional relationship between the jet water conduit and a bowl of the flush toilet according to the fourth embodiment of the present invention.

Since a basic configuration of the flush toilet according to the fourth embodiment is similar to that of the third embodiment described above, only portions that differ from the third embodiment will be hereinafter described.

As shown in FIGS. 19A and 19B, an upstream flow channel 316*a* of a jet water conduit 316 is provided with a third air retaining portion 354 extending higher than an upper surface 316*g* of the upstream flow channel 316*a*. Accordingly, when flush water flows through the jet water conduit 316, air retained in the jet water conduit 316 or/and air flowing into the jet water conduit 316 from the overflow pipe 30 is pushed into the third air retaining portion 354.

The third air retaining portion 354 is equipped with a wall surface 354*a* on an upstream side which extends upward, an upper surface 354*b* extending forward from the wall surface 354*a*, and a wall surface 354*c* on a downstream side which extends downward from a front end of the upper surface 354*b* and is formed in a trapezoidal shape. Accordingly, air having flowed into the third air retaining portion 354 can be collected in an upper part and a larger amount of air can be retained. In addition, the upstream-side wall surface 354*a* extends approximately vertically and the downstream-side wall surface 354*c* extends while being inclined downward toward the front. Accordingly, a situation can be prevented where a flow toward a jet spout port 314 is impeded due to flush water which flows in the upstream flow channel 316*a* in a lateral direction excessively flowing into the third air retaining portion 354.

Next, as shown in FIG. 19B, the third air retaining portion 354 is formed along a bowl 306. Accordingly, a dead space behind the bowl 306 can be effectively utilized and the toilet as a whole can be made compact. The upper surface 354*b* of the third air retaining portion 354 is positioned at approximately the same position as a lower end of a rim 320. Accordingly, air can be reliably retained in the third air retaining portion 354.

The present invention is not limited to the embodiments described above and various changes and modifications can be made within the scope of the technical ideas as set forth in the claims.

REFERENCE SIGNS LIST

1 flush toilet according to first embodiment
2 toilet main body
4 reservoir tank
6 bowl
8 discharge trap conduit
8*a* inlet of discharge trap conduit
8*b* ascending conduit of discharge trap conduit
8*c* descending conduit of discharge trap conduit
8*d* top portion of discharge trap conduit
8*e* upper end of inlet of discharge trap conduit
10 rim spout port
14 jet spout port
14*a* upper end of jet spout port
16 jet water conduit
16*a* upstream flow channel of jet water conduit
16*b* bending flow channel of jet water conduit
16*c* downstream flow channel of jet water conduit
16*d* bottom surface of upstream flow channel of jet water conduit
16*e* bottom surface of bending flow channel of jet water conduit
16*f* bottom surface of downstream flow channel of jet water conduit
16*g* upper surface of upstream flow channel of jet water conduit
16*h* upper surface of bending flow channel of jet water conduit
16*i* upper surface of downstream flow channel of jet water conduit
18 waste receiving surface
20 rim
26 discharge device
30 overflow pipe
32 discharge valve
40 curved portion
42 rectifying portion
D eccentric distance
F1 flush water on side of inner circumference surface
F2 flush water on side of outer circumference surface
O1 center of jet spout port
O2 center of inlet of discharge trap conduit
O3 center of downstream end of bending flow channel
X center axis of jet water conduit
Q1, q1 first flow rate
Q1*max*, q1*max* maximum instantaneous flow rate of first flow rate
A, a increasing rate of first flow rate
Q2, q2 second flow rate
Q2*max*, q2*max* maximum instantaneous flow rate of second flow rate
B, b increasing rate of second flow rate
R1 curvature radius of upstream side of outer circumference surface
R2 curvature radius of downstream side of outer circumference surface
r1 curvature radius of upstream side of inner circumference surface
r2 curvature radius of downstream side of inner circumference surface
W seal water surface
100 flush toilet according to second embodiment
114 jet spout port
114*a* upper end of jet spout port
114*b* lower end of jet spout port
116 jet water conduit
116*a* upstream flow channel of jet water conduit
116*b* bending flow channel of jet water conduit
116*c* downstream flow channel of jet water conduit
150 buffer portion
150*a* upstream end portion of buffer portion
152 connecting portion
D1 distance from lower end of jet spout port to inlet of discharge trap conduit
D2 distance from upper end of jet spout port to inlet of discharge trap conduit
O101 center of jet spout port O104 center of flow channel cross section of buffer portion
R101 curvature radius of side of outer circumference surface of upstream end portion of buffer portion
r101 curvature radius of side of inner circumference surface of upstream end portion of buffer portion
R102 curvature radius of side of outer circumference surface of connecting portion
r102 curvature radius of side of inner circumference surface of connecting portion
200 flush toilet according to third embodiment
214 jet spout port
216 jet water conduit
216*a* upstream flow channel of jet water conduit
216*b* bending flow channel of jet water conduit
216*c* downstream flow channel of jet water conduit
244 narrowed portion
246 constant cross-sectional area portion
250 first air retaining portion
252 second air retaining portion
R201 curvature radius of upstream side of outer circumference surface
R202 curvature radius of downstream side of outer circumference surface
r201 curvature radius of upstream side of inner circumference surface
r202 curvature radius of downstream side of inner circumference surface

What is claimed is:

1. A siphon jet flush toilet, comprising:
a reservoir tank configured to store flush water;
a bowl including a bowl-shaped waste receiving surface and a rim formed along a top edge portion of the bowl;
a rim spout port provided on the rim and configured to spout the flush water toward the bowl;
a discharge trap conduit provided in a bottom portion of the bowl and including an ascending conduit that extends upward, a descending conduit that extends downward from the ascending conduit, and a top portion that is positioned between the descending conduit and the ascending conduit and that regulates a seal water level;
a jet spout port provided in the bottom portion of the bowl and configured to spout the flush water toward an inlet of the discharge trap conduit;
a jet water conduit connecting the jet spout port and the reservoir tank to each other and configured to supply the flush water from the reservoir tank to the jet spout port; and
a discharge device configured to supply or stop supplying the flush water stored in the reservoir tank to the jet water conduit,
wherein the flush water is spouted at a first flow rate from the jet spout port when the discharge device is driven and the flush water in the reservoir tank flows into the jet water conduit and, after spouting of the first flow rate ends, the flush water is spouted at a second flow rate from the jet spout port due to the flush water retained in the jet water conduit flowing toward the jet spout port, and
wherein the flush water is spouted at the second flow rate from the jet spout port after the discharge device stops.

2. The flush toilet according to claim 1, wherein a maximum instantaneous flow rate of the second flow rate is set smaller than a maximum instantaneous flow rate of the first flow rate.

3. The flush toilet according to claim 2, wherein an instantaneous flow rate of the second flow rate is set so as to reach the maximum instantaneous flow rate by increasing more gradually than an instantaneous flow rate of the first flow rate.

4. The flush toilet according to claim 1, wherein a flush water amount is set to be switched between a large flush and a small flush by adjusting a jet spouting time by the first flow rate.

5. The flush toilet according to claim 1, wherein the jet water conduit includes an upstream flow channel extending forward from the reservoir tank, a bending flow channel bending from the upstream flow channel, and a downstream flow channel extending rearward from the bending flow channel and connecting to the jet spout port, and
the upstream flow channel is arranged approximately parallel to the discharge trap conduit and a bottom surface on a downstream side of the upstream flow channel is positioned lower than an upper end of the inlet of the discharge trap conduit.

6. The flush toilet according to claim 5, wherein in a region more toward the front than the top portion of the discharge trap conduit, the bottom surface of the upstream flow channel is positioned lower than the upper end of the inlet of the discharge trap conduit.

7. The flush toilet according to claim 5, wherein a center of the jet spout port is arranged at a lowermost position of a center axis of the jet water conduit.

8. The flush toilet according to claim 1, wherein the reservoir tank is provided with an overflow pipe configured to discharge overflowing water in the reservoir tank, and the overflow pipe is provided at a same position as the discharge device or more toward the rear than the discharge device.

9. The flush toilet according to claim 1, wherein the jet water conduit has a capacity of ⅓ or more of the reservoir tank.

10. A siphon jet flush toilet, comprising:
a reservoir tank configured to store flush water;
a bowl including a bowl-shaped waste receiving surface and a rim formed along a top edge portion of the bowl;
a rim spout port provided on the rim and configured to spout the flush water toward the bowl;
a discharge trap conduit provided in a bottom portion of the bowl and including an ascending conduit that extends upward, a descending conduit that extends downward from the ascending conduit, and a top portion that is positioned between the descending conduit and the ascending conduit and that regulates a seal water level;
a jet spout port provided in the bottom portion of the bowl and configured to spout the flush water toward an inlet of the discharge trap conduit;
a jet water conduit connecting the jet spout port and the reservoir tank to each other and configured to supply the flush water from the reservoir tank to the jet spout port; and
a discharge device configured to supply or stop supplying the flush water stored in the reservoir tank to the jet water conduit,
wherein the flush water is spouted at a first flow rate from the jet spout port when the discharge device is driven and the flush water in the reservoir tank flows into the jet water conduit and, after spouting of the first flow rate ends, the flush water is spouted at a second flow rate from the jet spout port due to the flush water retained in the jet water conduit flowing toward the jet spout port, and wherein the jet water conduit includes an upstream flow channel extending forward from the reservoir tank, a bending flow channel bending from the upstream flow channel, and a downstream flow channel extending rearward from the bending flow channel and connecting to the jet spout port, a curved portion eccentrically positioned on an opposite side to the upstream flow channel with respect to the center axis of the jet spout port in a top view is formed in the downstream flow channel of the jet water conduit, and the curved portion is arranged inside a seal water region in a top view.

11. The flush toilet according to claim 10, wherein the bending flow channel is arranged inside the seal water region in a top view.

12. The flush toilet according to claim 10, wherein a rectifying portion linearly extending toward the jet spout port is formed in the downstream flow channel on a downstream side of the curved portion.

13. A siphon jet flush toilet, comprising:

a reservoir tank configured to store flush water;

a bowl including a bowl-shaped waste receiving surface and a rim formed along a top edge portion of the bowl;

a rim spout port provided on the rim and configured to spout the flush water toward the bowl;

a discharge trap conduit provided in a bottom portion of the bowl and including an ascending conduit that extends upward, a descending conduit that extends downward from the ascending conduit, and a top portion that is positioned between the descending conduit and the ascending conduit and that regulates a seal water level;

a jet spout port provided in the bottom portion of the bowl and configured to spout the flush water toward an inlet of the discharge trap conduit;

a jet water conduit connecting the jet spout port and the reservoir tank to each other and configured to supply the flush water from the reservoir tank to the jet spout port; and a discharge device configured to supply or stop supplying the flush water stored in the reservoir tank to the jet water conduit, wherein the flush water is spouted at a first flow rate from the jet spout port when the discharge device is driven and the flush water in the reservoir tank flows into the jet water conduit and, after spouting of the first flow rate ends, the flush water is spouted at a second flow rate from the jet spout port due to the flush water retained in the jet water conduit flowing toward the jet spout port, and further comprising a buffer portion provided in the bottom portion of the bowl and communicating the jet spout port and the inlet of the discharge trap conduit to each other, wherein the jet water conduit includes an upstream flow channel extending forward from the reservoir tank, a bending flow channel bending from the upstream flow channel, and a downstream flow channel extending rearward from the bending flow channel and connecting to the jet spout port, and the jet water conduit and/or the buffer portion is configured such that flush water spouted from the jet spout port flows toward a center of the inlet of the discharge trap conduit.

14. The flush toilet according to claim 13, wherein a curvature radius on a downstream side of an inner circumference surface of the bending flow channel of the jet water conduit is smaller than a curvature radius on an upstream side in a top view.

15. The flush toilet according to claim 14, wherein a curvature radius on a downstream side of an outer circumference surface of the bending flow channel of the jet water conduit is larger than a curvature radius on an upstream side in a top view.

16. The flush toilet according to claim 15, wherein a bottom surface of the bending flow channel of the jet water conduit is formed approximately horizontally, an upper surface of the bending flow channel is inclined downward from an upstream side toward a downstream side, and a height position of the upper surface of the bending flow channel is higher on a side of the outer circumference surface than on a side of the inner circumference surface.

17. A siphon jet flush toilet, comprising:

a reservoir tank configured to store flush water;

a bowl including a bowl-shaped waste receiving surface and a rim formed along a top edge portion of the bowl;

a rim spout port provided on the rim and configured to spout the flush water toward the bowl;

a discharge trap conduit provided in a bottom portion of the bowl and including an ascending conduit that extends upward, a descending conduit that extends downward from the ascending conduit, and a top portion that is positioned between the descending conduit and the ascending conduit and that regulates a seal water level;

a jet spout port provided in the bottom portion of the bowl and configured to spout the flush water toward an inlet of the discharge trap conduit;

a jet water conduit connecting the jet spout port and the reservoir tank to each other and configured to supply the flush water from the reservoir tank to the jet spout port; and a discharge device configured to supply or stop supplying the flush water stored in the reservoir tank to the jet water conduit, wherein the flush water is spouted at a first flow rate from the jet spout port when the discharge device is driven and the flush water in the reservoir tank flows into the jet water conduit and, after spouting of the first flow rate ends, the flush water is spouted at a second flow rate from the jet spout port due to the flush water retained in the jet water conduit flowing toward the jet spout port, and wherein the jet water conduit includes an upstream flow channel extending forward from the reservoir tank, a bending flow channel bending from the upstream flow channel, and a downstream flow channel extending rearward from the bending flow channel and connecting to the jet spout port, a narrowed portion with a smallest flow channel cross-sectional area in the jet water conduit is formed in the downstream flow channel of the jet water conduit, and a constant cross-sectional area portion of which a flow channel cross-sectional area is constant is formed in the jet water conduit on an upstream side of the narrowed portion.

18. The flush toilet according to claim 17, wherein the flow channel cross-sectional area of the narrowed portion gradually contracts toward the jet spout port.

19. The flush toilet according to claim 17, wherein the constant cross-sectional area portion is formed in the bending flow channel.

* * * * *